US011203466B2

(12) United States Patent
Kobayashi et al.

(10) Patent No.: US 11,203,466 B2
(45) Date of Patent: Dec. 21, 2021

(54) STORAGE BOX

(71) Applicant: Iris Ohyama Inc., Sendai (JP)

(72) Inventors: Susumu Kobayashi, Miyagi (JP); Shuhei Yamashiro, Miyagi (JP)

(73) Assignee: IRIS OHYAMA INC., Sendai (JP)

( * ) Notice: Subject to any disclaimer, the term of this patent is extended or adjusted under 35 U.S.C. 154(b) by 0 days.

(21) Appl. No.: 16/937,489

(22) Filed: Jul. 23, 2020

(65) Prior Publication Data

US 2021/0139186 A1 May 13, 2021

(30) Foreign Application Priority Data

Jun. 20, 2019 (JP) ..... JP2019-114479

(51) Int. Cl.

| | |
|---|---|
| ***B65D 5/00*** | (2006.01) |
| ***B65D 21/02*** | (2006.01) |
| ***B65D 21/04*** | (2006.01) |
| ***B65D 43/20*** | (2006.01) |
| ***E05D 15/58*** | (2006.01) |

(52) U.S. Cl.

CPC ..... *B65D 43/20* (2013.01); *B65D 5/001* (2013.01); *B65D 5/0095* (2013.01); *B65D 21/0212* (2013.01); *B65D 21/0213* (2013.01); *B65D 21/0219* (2013.01); *B65D 21/0233* (2013.01); *B65D 21/04* (2013.01); *E05D 15/58* (2013.01)

(58) Field of Classification Search

CPC .. B65D 5/0095; B65D 5/001; B65D 21/0212; B65D 21/0213; B65D 21/0219; B65D 21/0233; B65D 21/04; B65D 43/20; A47B 88/48; E05D 15/58; E05D 15/582

USPC ..... 206/505; 220/811–813; 312/322

See application file for complete search history.

(56) References Cited

U.S. PATENT DOCUMENTS

| | | | | |
|---|---|---|---|---|
| 3,127,889 A * | 4/1964 | Mills | E05D 15/582 | 126/194 |
| 4,760,921 A * | 8/1988 | Licari | A47B 87/0269 | 206/504 |
| 2015/0232238 A1* | 8/2015 | Wu | B65D 25/38 | 220/811 |

FOREIGN PATENT DOCUMENTS

JP 2016-094239 A 5/2016

* cited by examiner

*Primary Examiner* — Andrew D Perreault

(74) *Attorney, Agent, or Firm* — Studebaker & Brackett PC

(57) ABSTRACT

A storage box is configured to include a rectangular parallelepiped box-shaped case main body that is opened to a front side and an upper side, a top plate that is assembled to an upper end part of the case main body, and a rectangular frame-shaped frame member is assembled to the front end part of the case main body and the front end part of the top plate. As a result, the rigidity of the front end part of the storage box can be increased by the frame member. In addition, the opening-closing panel is rotatably assembled to the frame member. The opening-closing panel is disposed at the rotation position by being rotated from the closed position to the front side, and by sliding from the rotation position to the rear side the rail portion of the case main body is slid, and then, is disposed at the housing position.

6 Claims, 16 Drawing Sheets

STORAGE BOX

BACKGROUND OF THE INVENTION

Field of the Invention

The present disclosure relates to a storage box.

Background Art

A storage box disclosed in JP-A-2016-94239 below is configured to include a box main body that is opened to an upper side and a front side, and a top plate portion and a lid opening-closing portion that are assembled to the box main body. The lid opening-closing portion is configured to be movable between a closed position that covers a front opening portion and an open position that is disposed in a gap between the top plate portion and a side plate portion of the box main body. At the open position of the lid opening-closing portion, since the lid opening-closing portion is stored inside the box main body, it is easy to put storage articles in and out of the storage box.

SUMMARY OF THE INVENTION

However, in the storage box described above, when the top plate portion is assembled to the box main body, since the storage box is formed to be a bottomed rectangular cylindrical shape that is open to the front side, a rigidity of a front end part of the storage box tends to be lower than the rigidity of other portions. Therefore, there is a room for improvement in terms of increasing the rigidity of the storage box.

An object of the present disclosure is to provide a storage box in which the rigidity can be increased.

According to one or more embodiments of the present disclosure, a storage box includes: a rectangular parallelepiped box-shaped case main body that is opened to a front side and an upper side; a top plate that is assembled to an upper end part of the case main body; a pair of left and right rail portions that are formed on an upper end side part of a side wall of the case main body; a frame member that is formed in a rectangular frame shape, includes an opening portion inside, and is assembled to a front end part of the case main body and a front end part of the top plate; and an opening-closing panel that is assembled to the frame member so as to be rotatable between a closed position that closes the opening portion and a rotation position that is rotated from the closed position to the front side, and slides on the rail portion and is disposed at a housing position by sliding from the rotation position to the rear side.

In the storage box according to one or more embodiments of the present disclosure, an upper end part of the opening-closing panel is provided with a hinge piece formed to protrude toward an outside in a width direction, the hinge piece is configured to include a rotation rib that extends in a protrusion direction of the hinge piece and is guided by the frame member when the opening-closing panel is rotated, and a slide rib that extends in the protrusion direction of the hinge piece and sliding on the rail portion when the opening-closing panel slides, and a thickness of the slide rib is set to be thicker than a thickness of the rotation rib.

In the storage box according to one or more embodiments of the present disclosure, the frame member is provided with a support wall formed to support both side parts of the opening-closing panel in the width direction at the housing position, a rear end surface of both side parts of the opening-closing panel in the width direction is inclined to the rear side as going toward a lower side, and the slide rib protrudes toward the rear side from the upper end part of both side parts of the opening-closing panel in the width direction.

In the storage box according to one or more embodiments of the present disclosure, a distance in a front-rear direction from a front surface of the opening-closing panel to a rear end surface of the slide rib is set to be the same as a thickness of a lower end part of both side parts of the opening-closing panel in the width direction.

According to one or more embodiments of the present disclosure, the rigidity can be increased.

DETAILED DESCRIPTION OF THE INVENTION

Figure 1:
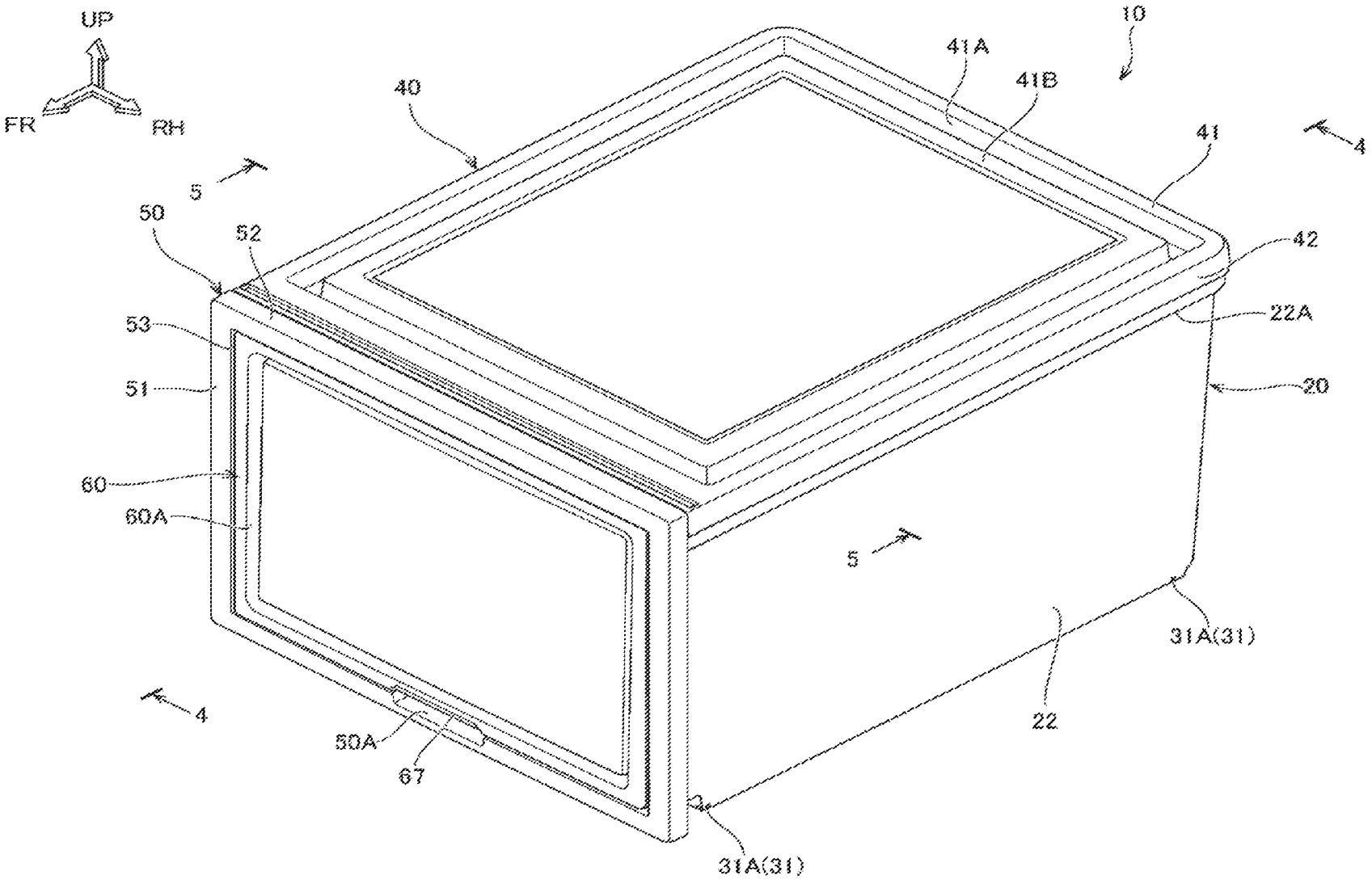
FIG. 1 is a perspective view illustrating a storage box according to a present embodiment.

Hereinafter, a storage box 10 according to a present embodiment will be described with reference to the drawings. Arrows UP, FR, and RH appropriately illustrated in the drawings indicate an upper side, a front side, and a right side (one side in the width direction) of the storage box 10, respectively. In the description below, an up-low direction, a front-rear direction, and a left-right direction will be referred to as a vertical direction, a front-rear direction, and a left-right direction of the storage box 10 unless otherwise specified.

Regarding Overall Configuration of Storage Box

As illustrated in FIG. 1, the storage box 10 is formed in a hollow, substantially rectangular parallelepiped box shape. The storage box 10 is configured to include a case main body 20 that configures a main body of the storage box 10, a top plate 40 that configures an upper end part of the storage box 10, a frame member 50 that configures a front end part of the storage box 10, and an opening-closing panel 60 that is assembled to the frame member 50 so as to be open and closed. The top plate 40 and the frame member 50 are assembled to the case main body 20 so that they can be disassembled (attachable and detachable).

Figure 2:
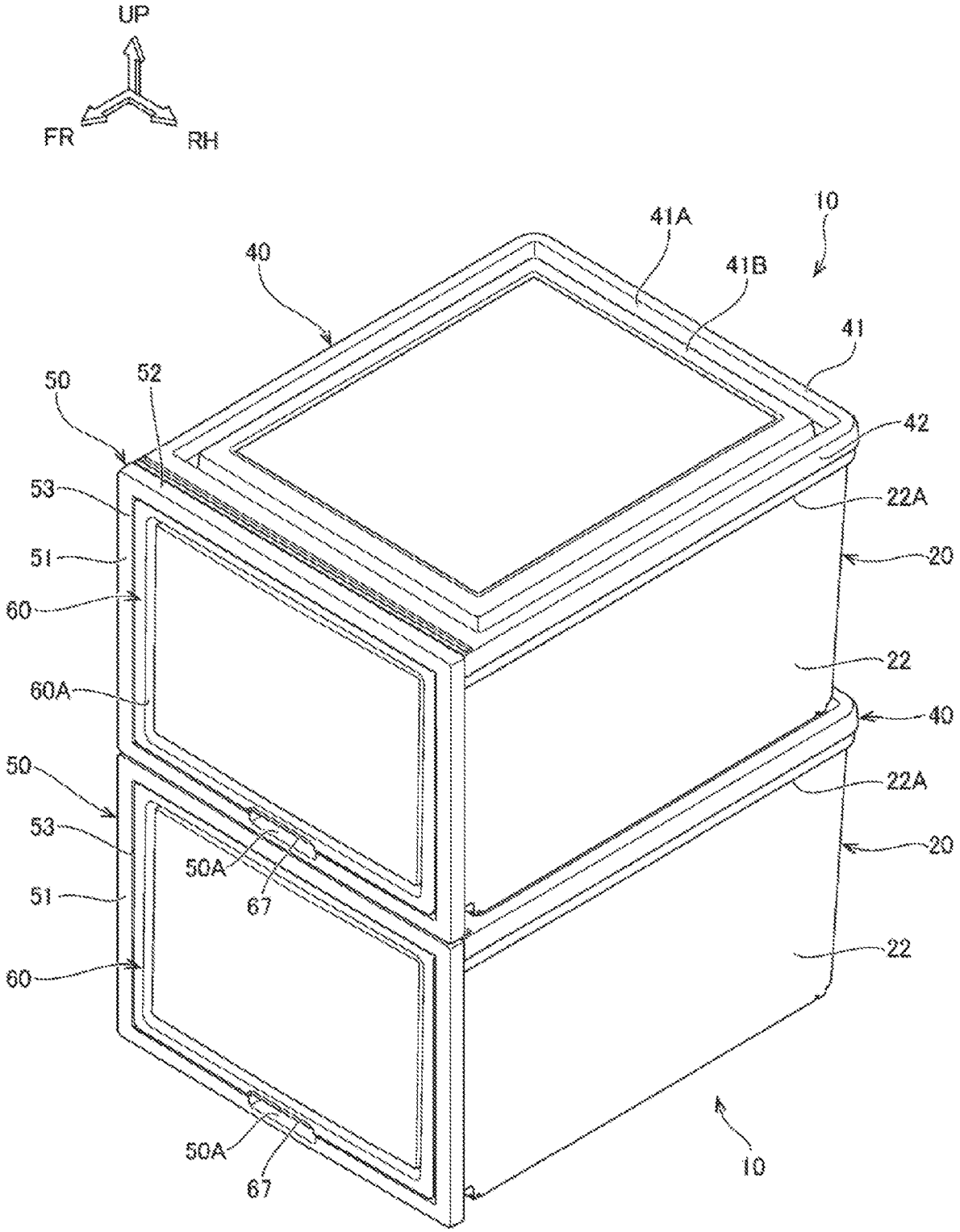
FIG. 2 is a perspective view illustrating a stacking state of the storage box illustrated in FIG. 1.
Figure 3:
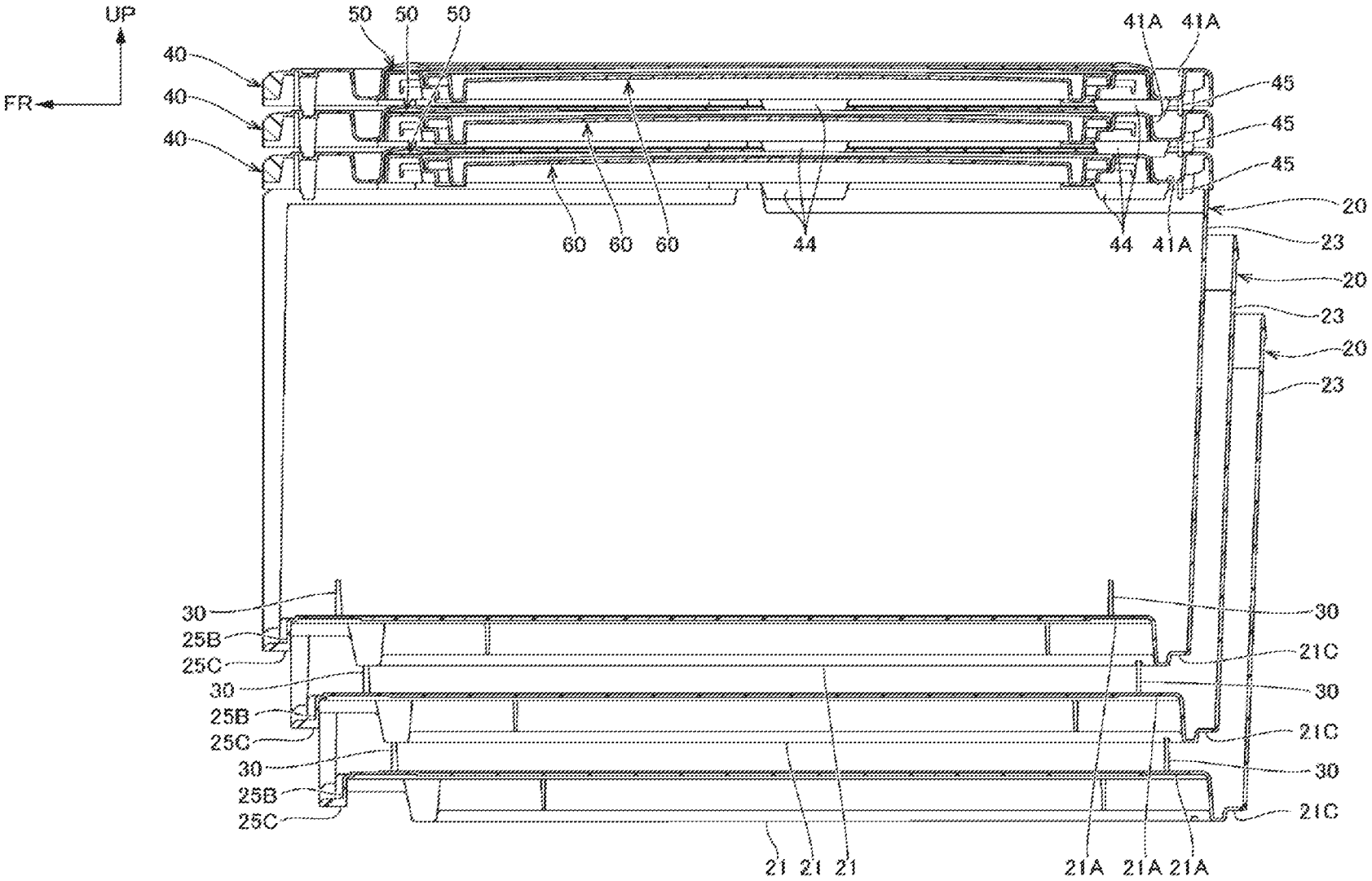
FIG. 3 is a side sectional view illustrating a state in which the case main bodies illustrated in FIG. 1 are nested.

As illustrated in FIG. 2, the storage box 10 is configured to be vertically stackable by stacking the storage boxes 10 (FIG. 2 illustrates an example of stacking the storage boxes 10 in two stages). Furthermore, as illustrated in FIG. 3, when the storage box 10 is disassembled, the case main body 20 is configured to be vertically nested by stacking the case main bodies 20 (FIG. 3 illustrates an example of nesting the case main body 20 in three stages). In addition, in a state in which the storage box 10 is disassembled, the frame member 50 to which the opening-closing panel 60 is assembled is held by the top plate 40, and the top plate 40 in this state can be stacked vertically. In this way, in the packaging state of the storage box 10, or the like, the top plate 40 holding the frame member 50 and the opening-closing panel 60 can be stacked on the upper side of the nested case main body 20. Hereinafter, each configuration of the storage box 10 will be described.

Regarding Case Main Body

As illustrated in FIG. 4 to FIG. 8C, the case main body 20 is made of a resin material and is formed in a substantially rectangular parallelepiped box shape opened to the upper side and the front side. Specifically, the case main body 20 is configured to include a substantially rectangular plate-shaped bottom wall 21 having the vertical direction as a plate thickness direction and the front-rear direction as a longitudinal direction, a pair of left and right side walls 22 extending from both end parts of the bottom wall 21 in the width direction to the upper side, and a rear wall 23 extending from a rear end part of the bottom wall 21 to the upper side. The inside of the case main body 20 is configured as a storage portion 24 for storing the storage articles.

The side wall 22 is inclined toward the outside of the case main body 20 in the width direction in a front view as going toward the upper side. In addition, the rear wall 23 is inclined to the rear side in a side view as going toward the upper side. As a result, in a disassembled state of the storage box 10, the case main body 20 is disposed inside another case main body 20, and thus, the case main body 20 can be nested.

In a portion excluding outer peripheral portions at the left and right and an outer peripheral portion at the rear side, a drawer portion 21A which goes up to the upper side by one stage is formed on the bottom wall 21. The drawer portion 21A is formed in a substantially rectangular shape with the front-rear direction as a longitudinal direction in a plan view. In addition, the left and right end parts at the front end part of the drawer portion 21A are extended to the outside of the case main body 20 in the width direction, and are connected to a lower end part of the side wall 22. At a boundary portion of the left and right side walls of the drawer portion 21A and the bottom wall 21, a side step portion 21B (refer to FIG. 5) is formed, which is bent in a substantially crank shape and goes up to higher than the bottom wall 21 by one stage, and the side step portion 21B extends in the front-rear direction. Furthermore, at the boundary portion of the rear wall 23 and the bottom wall 21, a rear step portion 21C (refer to FIG. 4) is formed, which is bent in a crank shape and goes up to higher than the upper side of the bottom wall 21 by one stage, and the rear step portion 21C extends in the left-right direction.

At the front end part of the case main body 20, a case side mounting portion 25 for mounting the frame member 50 described later is formed. The case side mounting portion 25 includes a pair of left and right side flange portions 25A that are bent outside in the width direction of the case main body 20 at the front end part of the side wall 22, and a lower flange portion 25B that is bent to the lower side at the front end part of the drawer portion 21A. Both the left and right end parts of the lower flange portion 25B are connected to the lower end part of the side flange portion 25A. In addition, the outer peripheral portion of the case side mounting portion 25 is configured as a mounting wall portion 25C, and the mounting wall portion 25C is bent to the front side at a distal end part of the side flange portion 25A and the lower flange portion 25B. The mounting wall portion 25C at the lower side is disposed on the upper side of the bottom wall 21.

At the upper end side part of the side wall 22, a rail step portion 22A is formed, which is bent toward the outside of the case main body 20 in the width direction in a substantially crank shape. Specifically, the rail step portion 22A is configured to include a first step wall 22A1 that is bent toward the outside of the case main body 20 in the width direction at an upper end side part of the side wall 22, and a second step wall 22A2 that is bent toward the upper side at a distal end part of the first step wall 22A1. The front end part of the first step wall 22A1 is connected to the upper end part of the side flange portion 25A, and the front end part of the second step wall 22A2 is connected to the upper end parts of the left and right mounting wall portions 25C.

A stopper portion 26 protruding to the upper side is formed at an intermediate part of the first step wall 22A1 in the front-rear direction. Furthermore, at the end part of a center side of the case main body 20 in the width direction in the first step wall 22A1, a rail wall 27 extending to the upper side is formed. The rail wall 27 extends from the front end part of the first step wall 22A1 to the rear side with the left-right direction as the plate thickness direction, and is connected to the stopper portion 26. A rail portion 28 is formed by the rail wall 27, the first step wall 22A1 and the second step wall 22A2, and the rail portion 28 is formed in a groove shape open to the upper side and the front side, and extends in the front-rear direction.

At the lower end part of the side wall 22 of the case main body 20, the engaging rib 30 (in a broad sense, an element recognized as "engagement portion") used when nesting the case main body 20, and an engaged portion 31 are provided. The engaging rib 30 and the engaged portion 31 form a pair, and the engaging rib 30 and the engaged portion 31 forming the pair are formed in four places in the case main body 20. Specifically, the pairs of engaging rib 30 and the engaged portion 31 are formed at the front end part (2 places) and the rear end part (2 places) of the lower end parts of the left and right side walls 22, respectively.

Figure 8C:
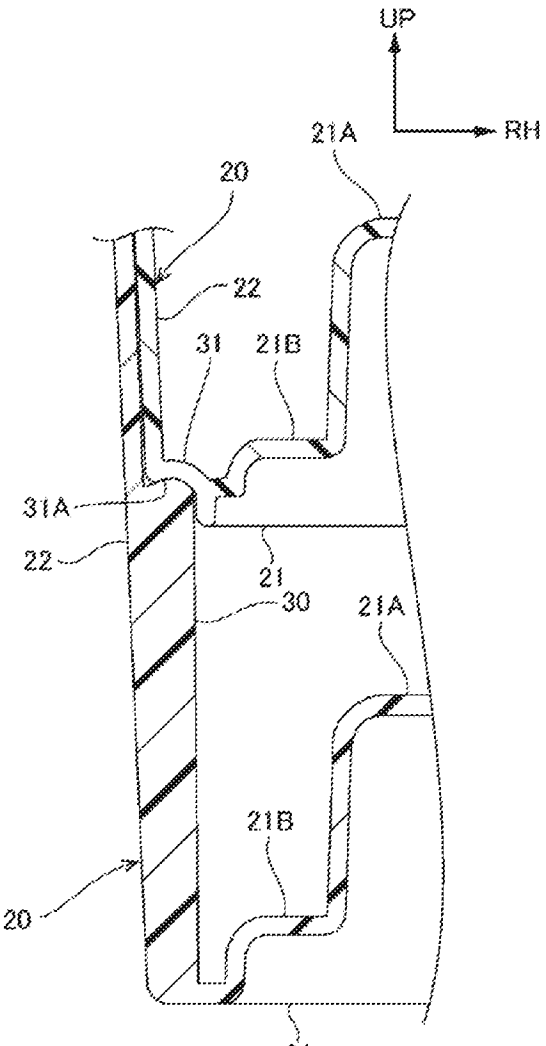
FIG. 8C is a sectional view illustrating an engaged state of the engaging rib and a groove portion of the engaged portion when nesting the case main body.
Figure 8B:
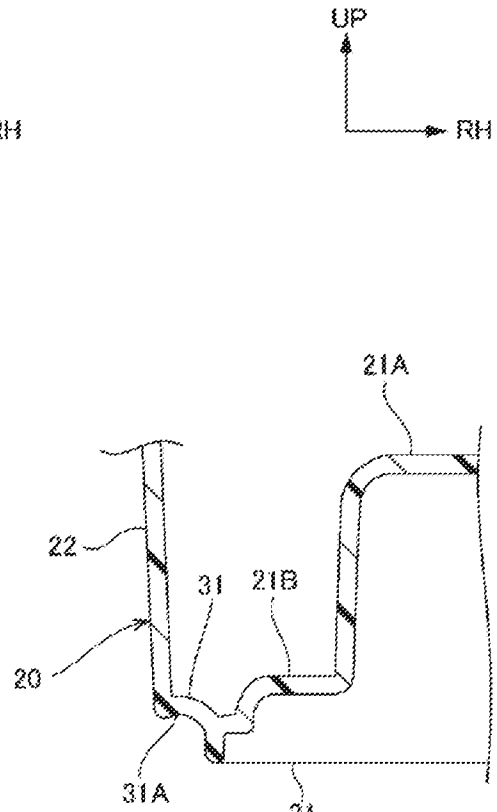
FIG. 8B is a sectional view (a sectional view taken along line VIIIB-VIIIB in FIG. 7) illustrating an engaged portion illustrated in FIG. 7.
Figure 8A:
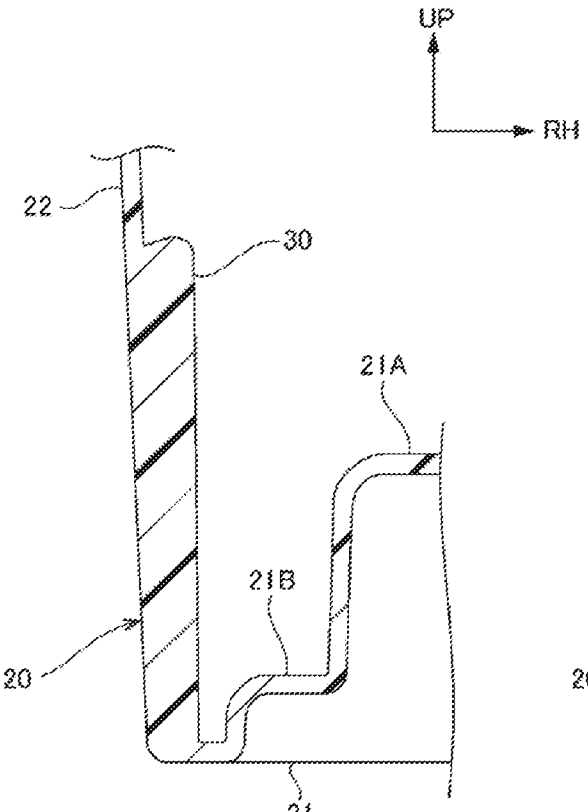
FIG. 8A is a sectional view (a sectional view taken along line VIIIA-VIIIA in FIG. 7) illustrating an engaging rib illustrated in FIG. 7.
Figure 9:
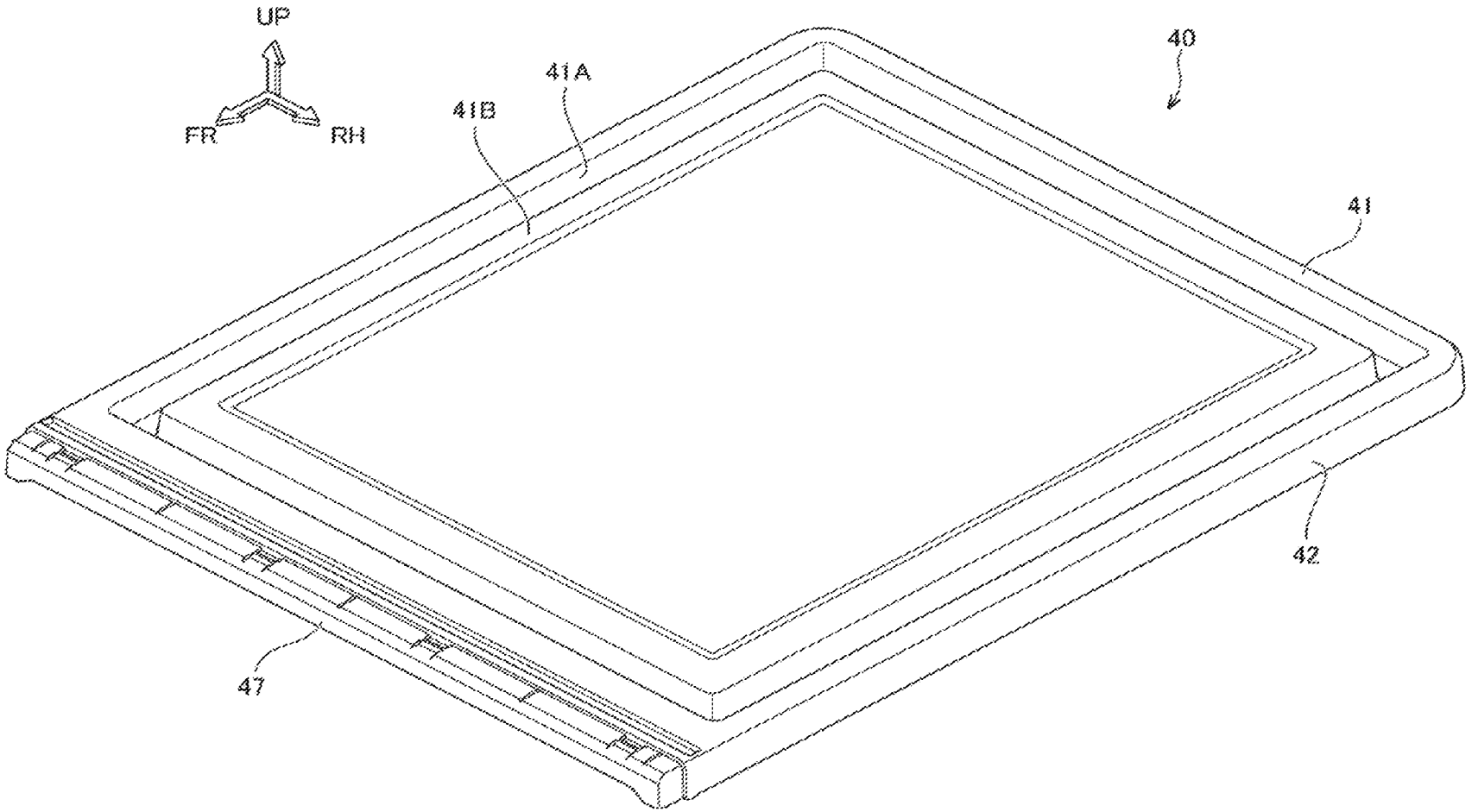
FIG. 9 is a perspective view of a top plate illustrated in FIG. 1.
Figure 10:
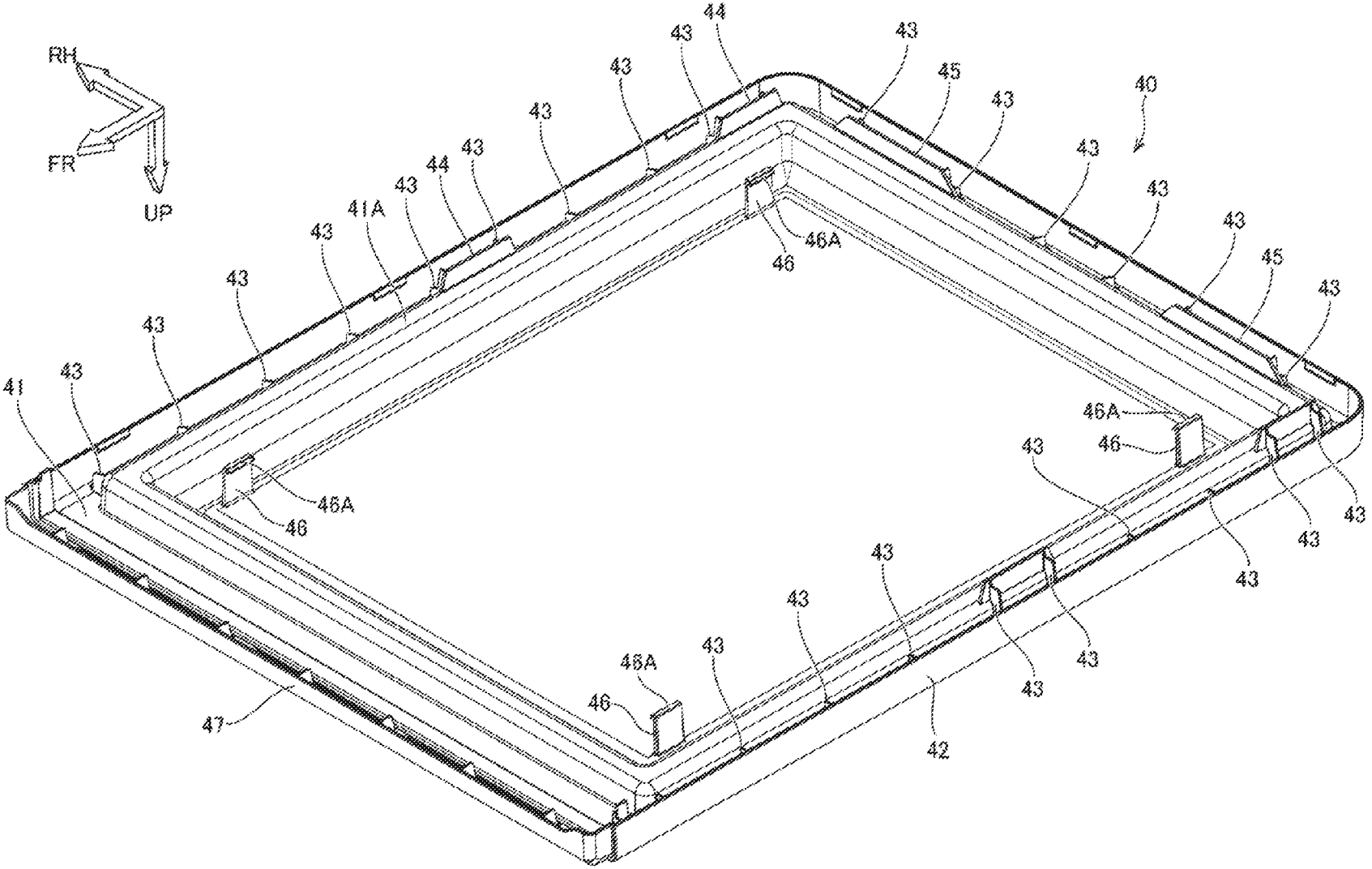
FIG. 10 is a perspective view of the top plate illustrated in FIG. 9 as viewed from a lower side.

As illustrated in FIG. 8A, the engaging rib 30 protrudes from the lower end part of the side wall 22 toward the inside of the case main body 20 in the width direction. In addition, the two engaging libs 30 disposed at the rear end part of the side wall 22 are extended from the bottom wall 21 to the upper side, and the two engaging libs 30 disposed at the front end part of the side wall 22 are extended from the drawer portion 21A of the bottom wall 21 to the upper side. The vertical positions of the upper end surfaces of the four engaging libs 30 are the same. That is, the length of the two engaging libs 30 in the vertical direction disposed at the rear side is set to be longer than the length of the two engaging libs 30 in the vertical direction disposed at the front side, and the upper end parts of the four engaging libs 30 are disposed at the upper side of the drawer portion 21A. In addition, the upper end surface of the engaging rib 30 is inclined toward the upper side as going toward the inside of the case main body 20 in the width direction in a front view, and the corner portion of the engaging rib 30 is curved in a substantially arc shape.

Figure 7:
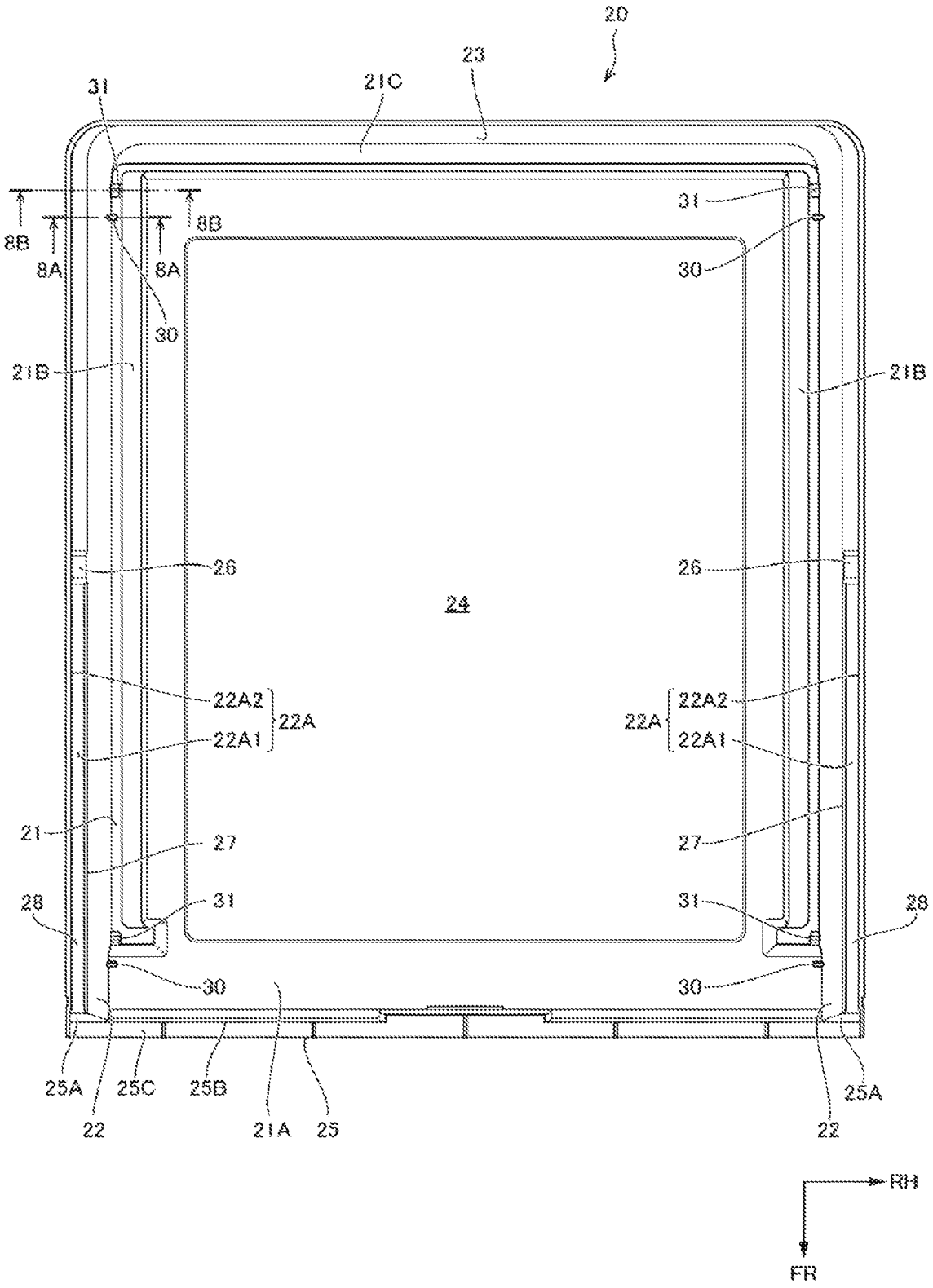
FIG. 7 is a plan view of the case main body illustrated in FIG. 6.

As illustrated in FIG. 7, the engaged portion 31 is disposed close to the rear side of the engaging rib 30. The engaged portion 31 protrudes from the side wall 22 to the inside of the case main body 20 in the width direction and protrudes from the bottom wall 21 to the upper side. As illustrated in FIG. 8B, an engagement groove portion 31A is formed in the engaged portion 31, and the engagement groove portion 31A is open to the outside of the case main body 20 in the width direction and the lower side thereof. That is, the engagement groove portion 31A is exposed to the outside at the corner portion of the lower side of the case main body 20 (the storage box 10).

In addition, the upper end surface of the engagement groove portion 31A is inclined to the upper side as going toward the inside of the case main body 20 in the width direction corresponding to the upper end surface of engaging rib 30. In addition, the corner portion of the upper side of the engagement groove portion 31A is curved in an arc shape corresponding to the corner portion of the engaging rib 30. The corner portion of the upper side of the engagement groove portion 31A may have an acute angle shape instead of an arc shape. Furthermore, a groove width of the engagement groove portion 31A is set to be slightly larger than a thickness dimension (dimension in the front-rear direction) of the engaging rib 30, a groove depth dimension of the engagement groove portion 31A in the vertical direction is set to be smaller than a height dimension of the engaging rib 30 in the vertical direction. The thickness dimension of the engaging rib 30 is set so as to become smaller as going toward the upper side. That is, the side surfaces of the engaging rib 30 are slightly inclined so as to approach each other as going toward the upper side.

As illustrated in FIG. 8C, in a state in which the case main bodies 20 are nested, the upper end part of the engaging rib 30 in the case main body 20 at the lower side (one side) is inserted into the engagement groove portion 31A in the case main body 20 at the upper side (the other side), the upper end surface of the engaging rib 30 comes in contact with the upper end surface of the engagement groove portion 31A. As a result, when nesting the case main bodies 20, the case main body 20 at the upper side is supported from the lower side by the engaging rib 30 of the case main body 20 at the lower side, and is disposed while being separated from the case main body 20 at the lower side. In addition, in this state, since the engaging rib 30 comes in contact with an inner peripheral surface of the engagement groove portion 31A, in the front-rear direction, a relative displacement of the case main body 20 at the upper side with respect to the case main body 20 at the lower side is suppressed.

Regarding Top Plate

As illustrated in FIG. 4, FIG. 5, FIG. 9, and FIG. 10, the top plate 40 is made of a resin material, and is formed in a substantially rectangular box shape having a relatively shallow bottom that is open to the lower side. Specifically, the top plate 40 is configured to include a substantially rectangular plate-shaped top plate main body 41 in which the vertical direction is the plate thickness direction and the front-rear direction is the longitudinal direction, and a top plate peripheral wall portion 42 bent to the lower side at an outer peripheral edge of the top plate main body 41. A top plate groove portion 41A opened to the upper side is formed at the outer peripheral portion of the top plate main body 41, and the top plate groove portion 41A extends along a circumferential direction of the top plate 40 and is formed in a rectangular ring shape in a plan view.

On a lower surface of the top plate 40, a plurality of mounting pieces 43 are formed at positions between the left and right top plate peripheral wall portions 42 and the rear side top plate peripheral wall portion 42 and the top plate groove portion 41A. The mounting piece 43 is disposed with the circumferential direction of the top plate groove portion 41A as the plate thickness direction, and is disposed with a predetermined interval in the circumferential direction of the top plate groove portion 41A. In addition, the mounting piece 43 is disposed so as to be separated from the top plate peripheral wall portion 42 at an inner side of the top plate 40. The upper end part of the side wall 22 of the case main body 20 and the upper end part of the rear wall 23 are inserted between the top plate peripheral wall portion 42 of the top plate 40 and the mounting piece 43, and the top plate 40 is assembled on the case main body 20.

The outer peripheral portion in the center part of the top plate main body 41 (portion surrounded by the top plate groove portion 41A) is configured as a grounding portion 41B, and the grounding portion 41B is slightly raised to the upper side of the top plate main body 41. In the stacking state of the storage box 10, the side step portion 21B of the case main body 20 at the upper side is grounded on the grounding portion 41B of the top plate 40 at the lower side, and a central part of the top plate 40 at the lower side is engaged into the left and right side step portion 21B (refer to the case main body 20 indicated by the chain double-dashed line in FIG. 5). As a result, a shift in the left-right direction between the storage boxes 10 is suppressed when stacking the storage box 10. In addition, in the state of stacking of the storage box 10, the rear step portion 21C of the case main body 20 at the upper side is grounded to an upper surface of the rear end part of the top plate 40 at the lower side, and the bottom wall 21 on a rear end side of the case main body 20 at the upper side is inserted into an inner peripheral portion of the top plate groove portion 41A of the top plate 40 at the lower side (refer to the case main body 20 indicated by a chain double-dashed line in FIG. 4). As a result, when stacking the storage boxes 10, the storage box 10 at the upper side is suppressed from being shifted to the front side from the storage box 10 at the lower side.

On the lower surface of the left and right top plate groove portions 41A, a pair of left and right first engagement pieces 44 (refer to FIG. 9) are respectively formed in the intermediate part in the front-rear direction and in the rear side portion. That is, four first engagement pieces 44 are formed in the top plate main body 41. The first engagement piece 44 extends in the front-rear direction with the left-right direction as the plate thickness direction, and protrudes from the top plate groove portion 41A to the lower side. In addition, on the lower surface of the top plate groove portion 41A at the rear side, a pair of left and right second engagement pieces 45 are formed. The second engagement piece 45 extends in the left-right direction with the front-rear direction as the plate thickness direction, and protrudes from the top plate groove portion 41A to the lower side. When vertically stacking the top plates 40 in the packaging state of the storage box 10, or the like, the first engagement piece 44 and the second engagement piece 45 of the top plate 40 at the upper side are inserted into an outer peripheral side portion of the top plate groove portion 41A of the top plate 40 at the lower side. As a result, in a state of vertically stacking the top plates 40, a movement of the top plate 40 at the upper side in the left-right direction and to the rear side are restricted by the first engagement piece 44 and the second engagement piece 45.

On the lower surface of the center part of the top plate main body 41 (the portion surrounded by the top plate groove portion 41A), a pair of left and right holding portions 46 (see FIG. 9) are formed in the intermediate part in the front-rear direction and the rear side portion. That is, four holding portions 46 are formed on the top plate main body 41. The holding portion 46 is formed in a substantially rectangular plate shape having the left-right direction as a plate thickness direction. A holding hook portion 46A is formed at the lower end part of the holding portion 46, and the holding hook portion 46A protrudes from the holding portion 46 toward the center side of the top plate 40 in the width direction. In addition, the holding portion 46 is disposed corresponding to an outer shape of the frame member 50 described later.

In addition, the front end part of the top plate 40 is configured as a top plate side mounting portion 47 for mounting a frame member 50 described later. The top plate side mounting portion 47 is formed in a shape lower than the upper surface of the top plate main body 41 and the left and right side surfaces of the top plate peripheral wall portion 42 by one stage.

Regarding Frame Member

Figure 4:
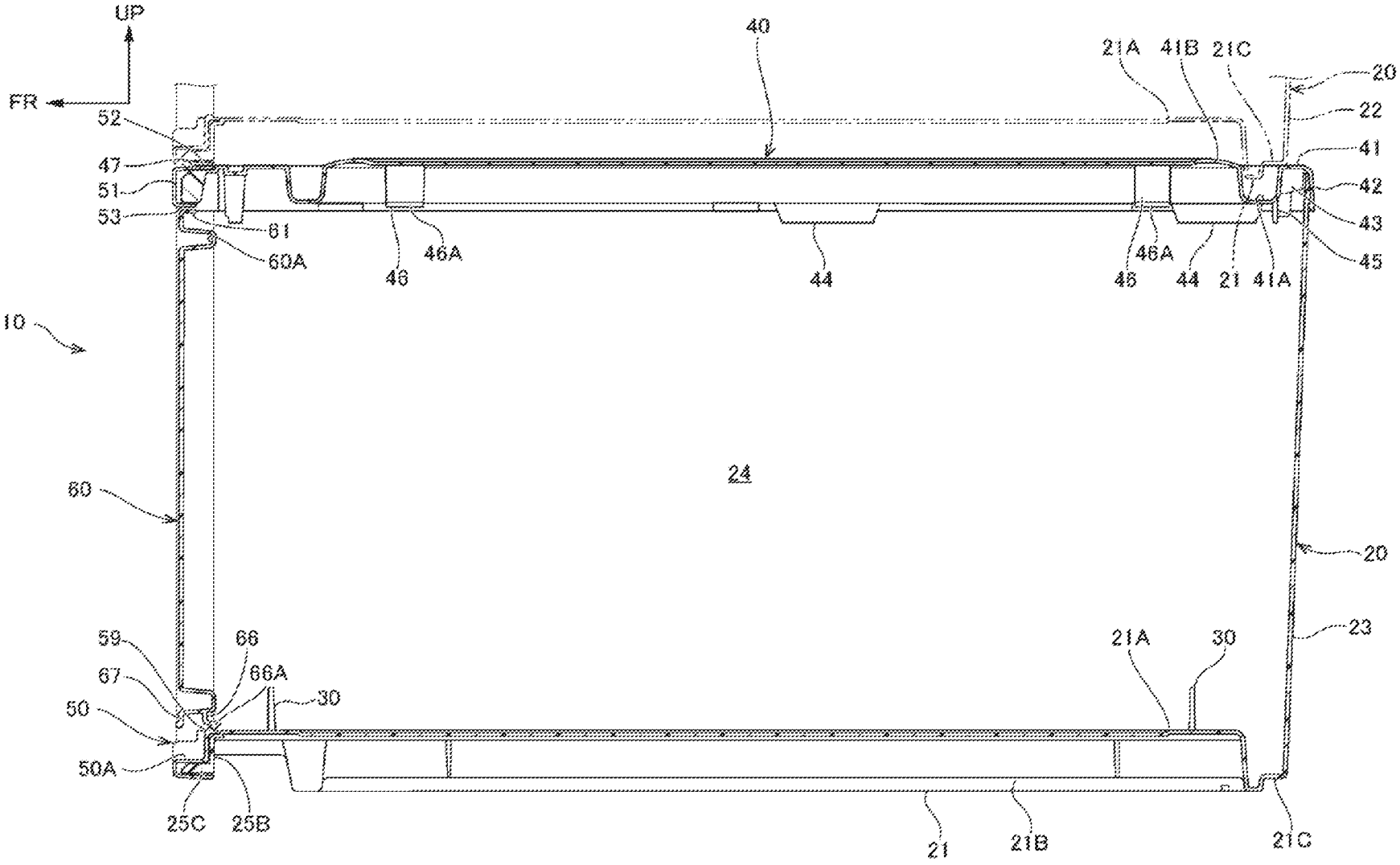
FIG. 4 is a side sectional view (a sectional view taken along line IV-IV in FIG. 1) viewed from a right side of the storage box illustrated in FIG. 1.
Figure 5:
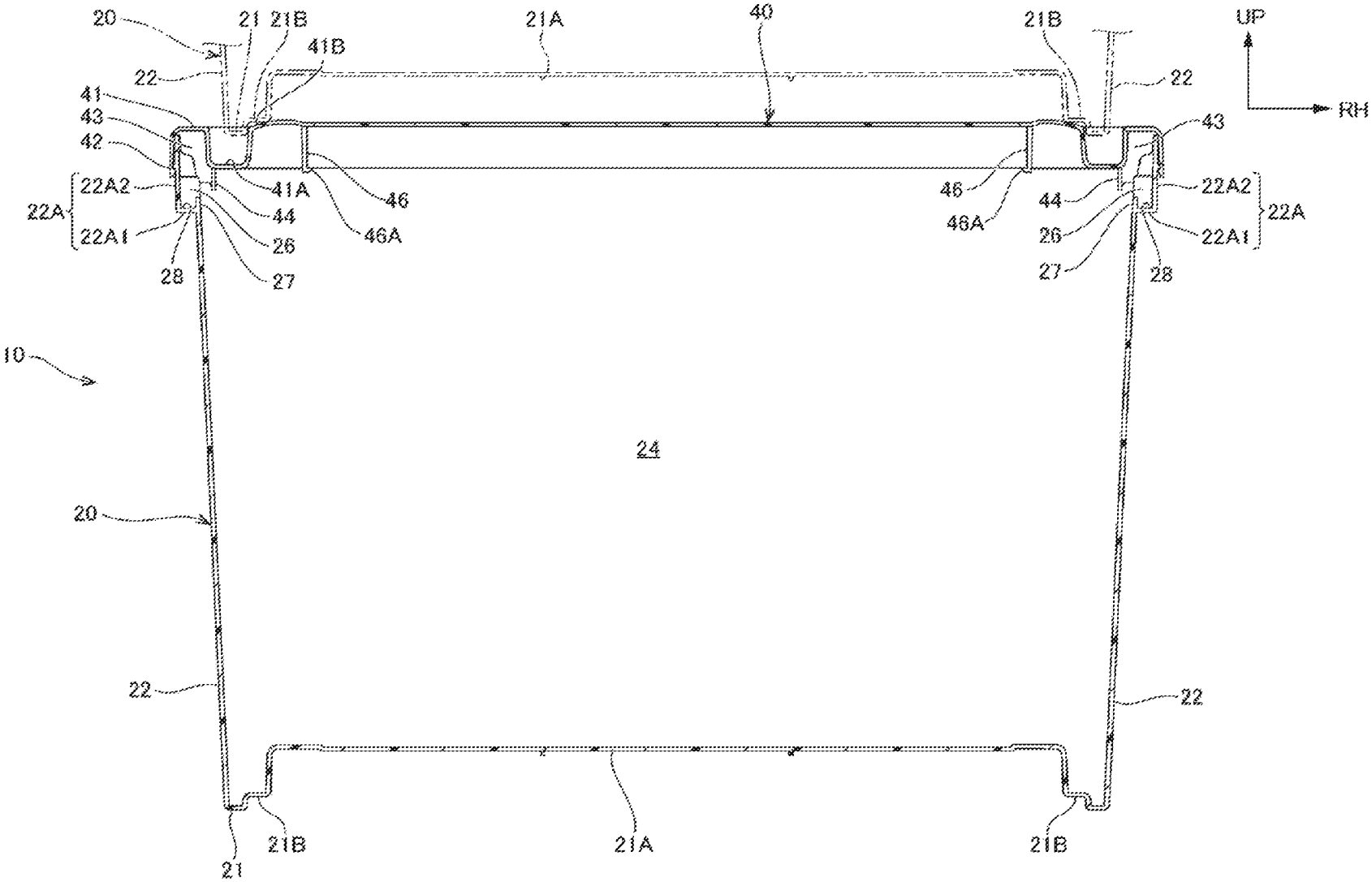
FIG. 5 is a sectional view (a sectional view taken along line V-V in FIG. 1) viewed from a front side of the storage box illustrated in FIG. 1.
Figure 6:
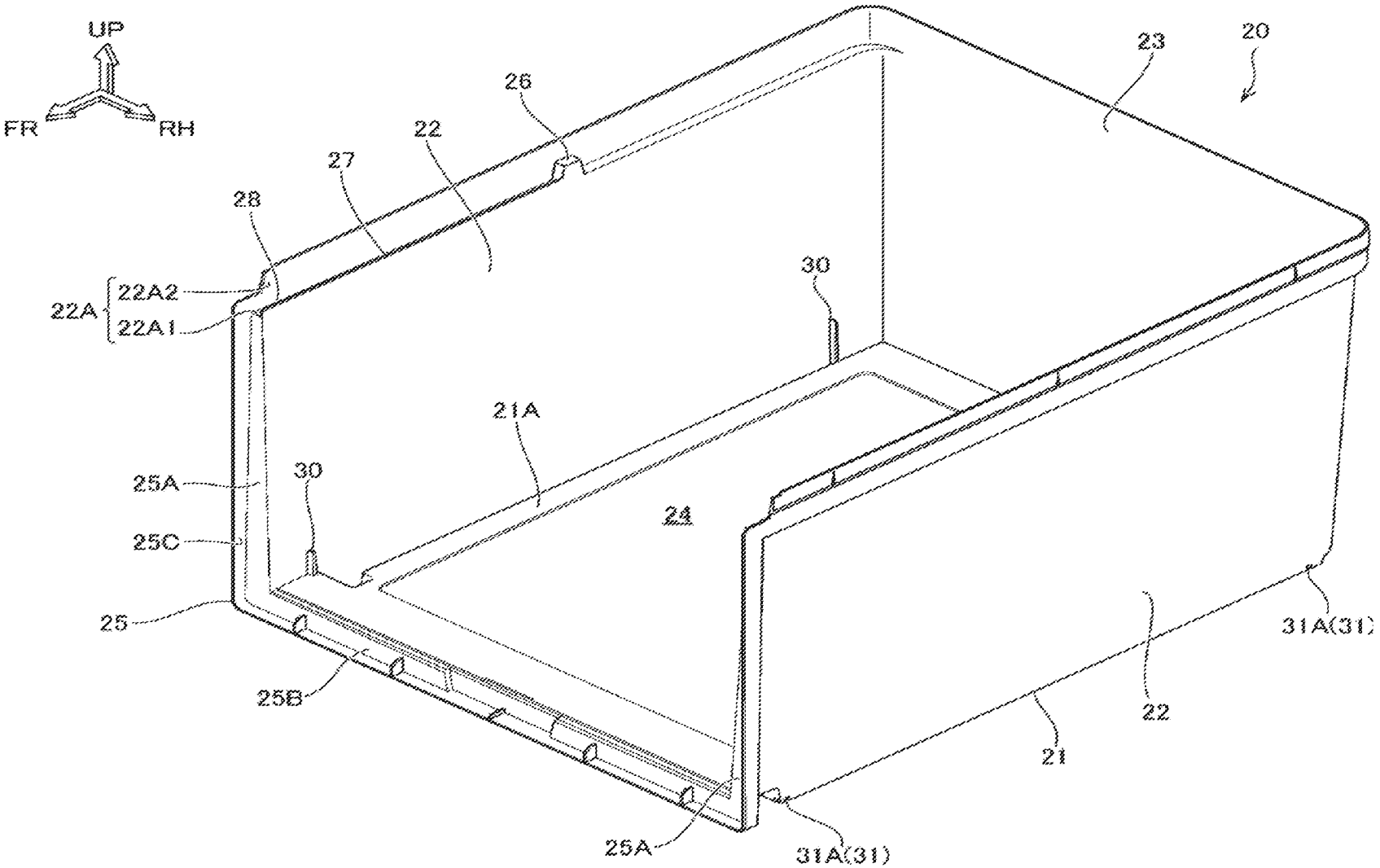
FIG. 6 is a perspective view of the case main body illustrated in FIG. 1.
Figure 11:
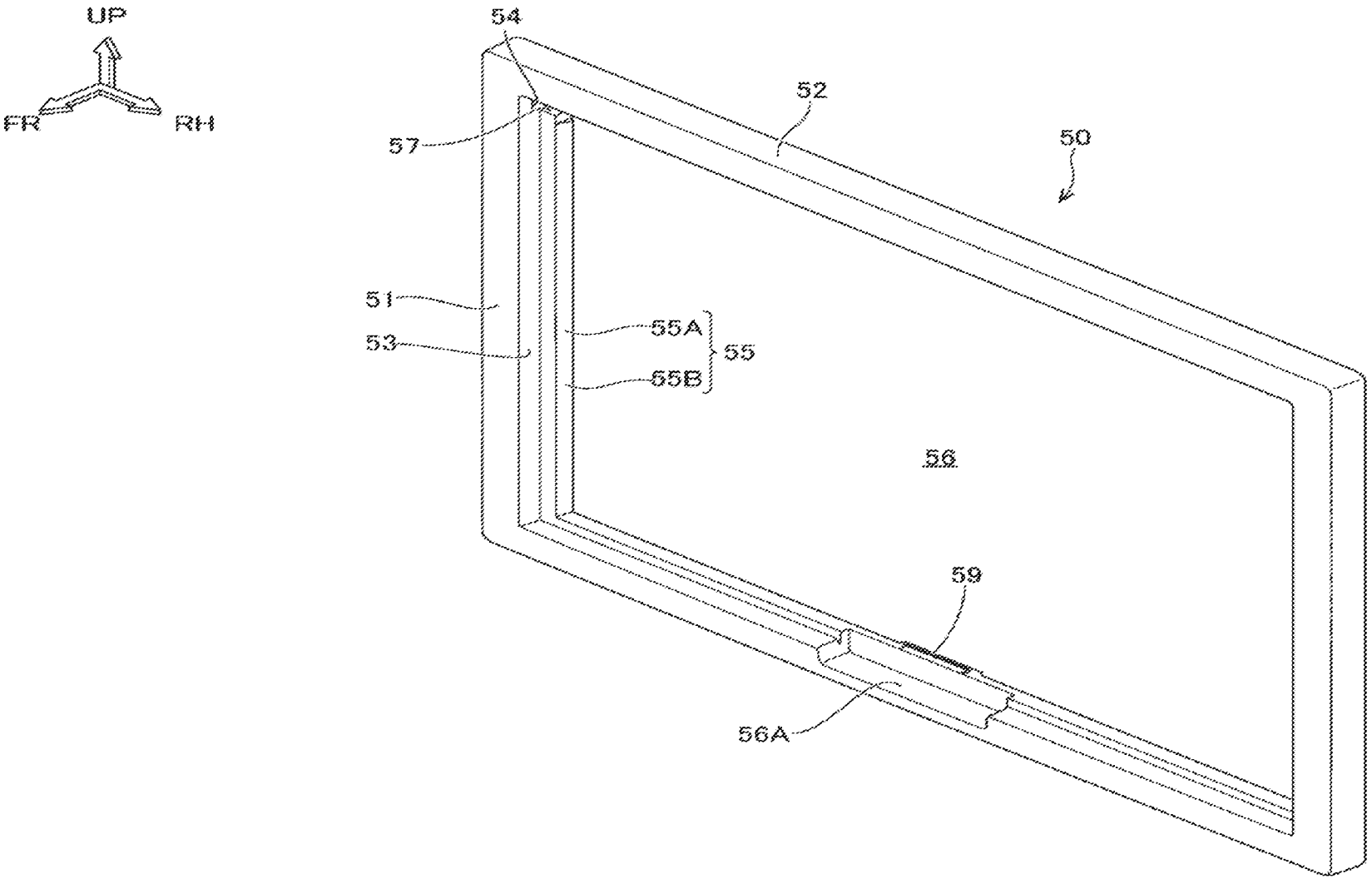
FIG. 11 is a perspective view of a frame member illustrated in FIG. 1.

As illustrated in FIG. 4 and FIG. 11, the frame member 50 is made of a resin material, has a rectangular frame shape in a front view, and has a concave shape opened to the rear side. Specifically, the frame member 50 is configured to include a frame main body 51 formed in a rectangular frame plate shape with the front-rear direction as a plate thickness direction, a frame outer peripheral wall 52 bent to a rear side on an outer peripheral edge of the frame main body 51, and a frame inner peripheral wall 53 bent to a rear side on an inner peripheral edge portion of the frame main body 51. The case side mounting portion 25 of the case main body 20 and the top plate side mounting portion 47 of the top plate 40 are engaged between the frame outer peripheral wall 52 and the frame inner peripheral wall 53 of the frame member 50, and thus, the frame member 50 is assembled on the case main body 20 and the top plate 40. As a result, when vertically stacking the storage boxes 10, since the rectangular shaped frame member 50 is vertically disposed side by side, a front appearance of the storage box 10 in the stacking state is configured to be rectangular (refer to FIG. 2). In addition, when disposing the storage boxes 10 side by side, the side surfaces of the frame members 50 disposed side by side are brought into close contact with each other to dispose the storage box 10.

Figure 12A:
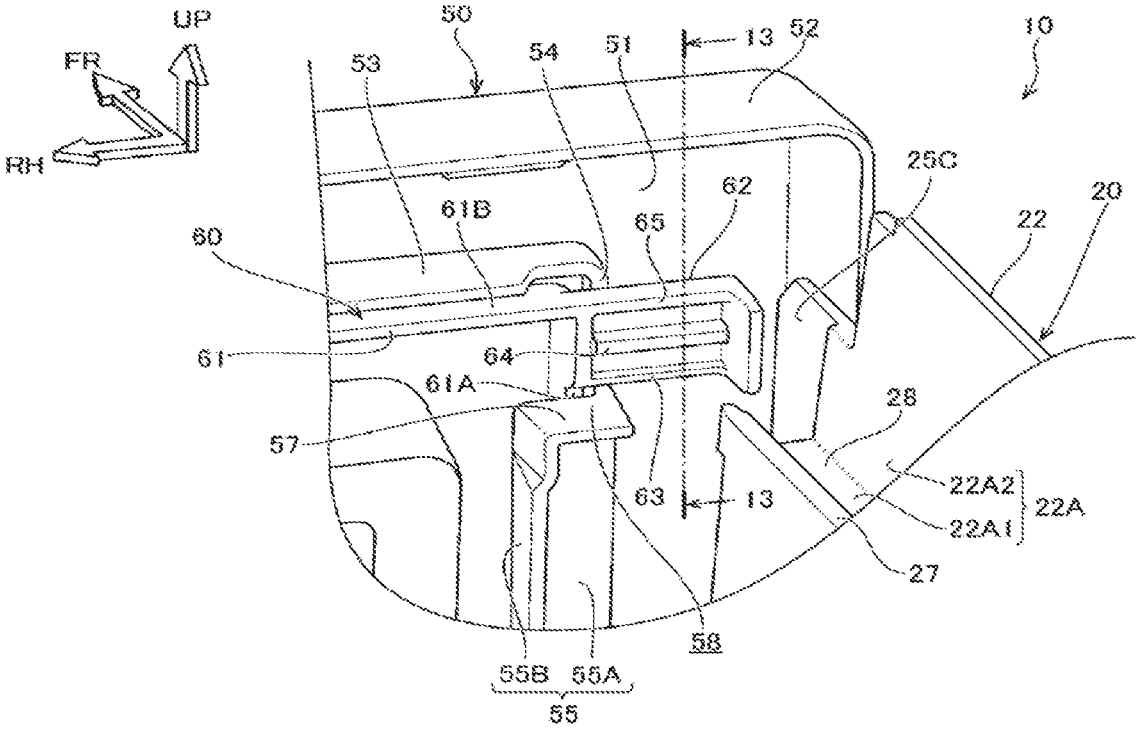
FIG. 12A is a perspective view seen from a rear side illustrating a state in which a hinge piece of an opening-closing panel illustrated in FIG. 1 is housed in a hinge housing portion of the frame member.
Figure 12B:
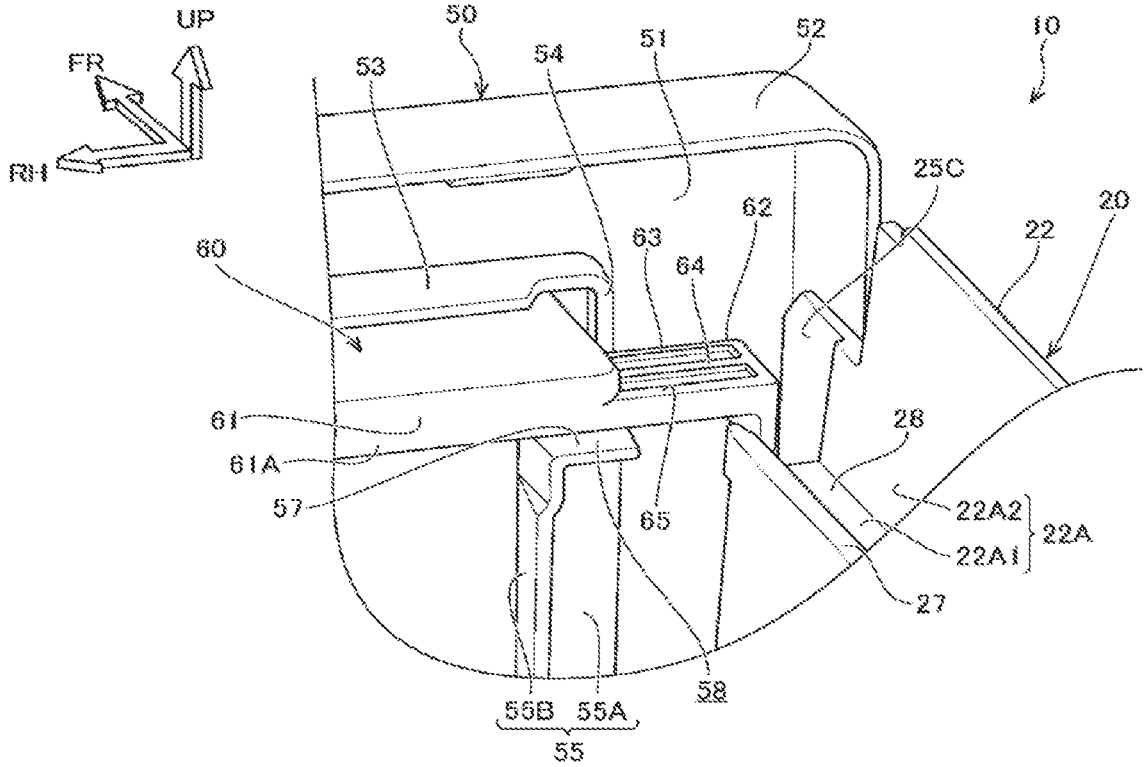
FIG. 12B is a perspective view illustrating a state in which the opening-closing panel illustrated in FIG. 12A is rotated to a rotation position.
Figure 13:
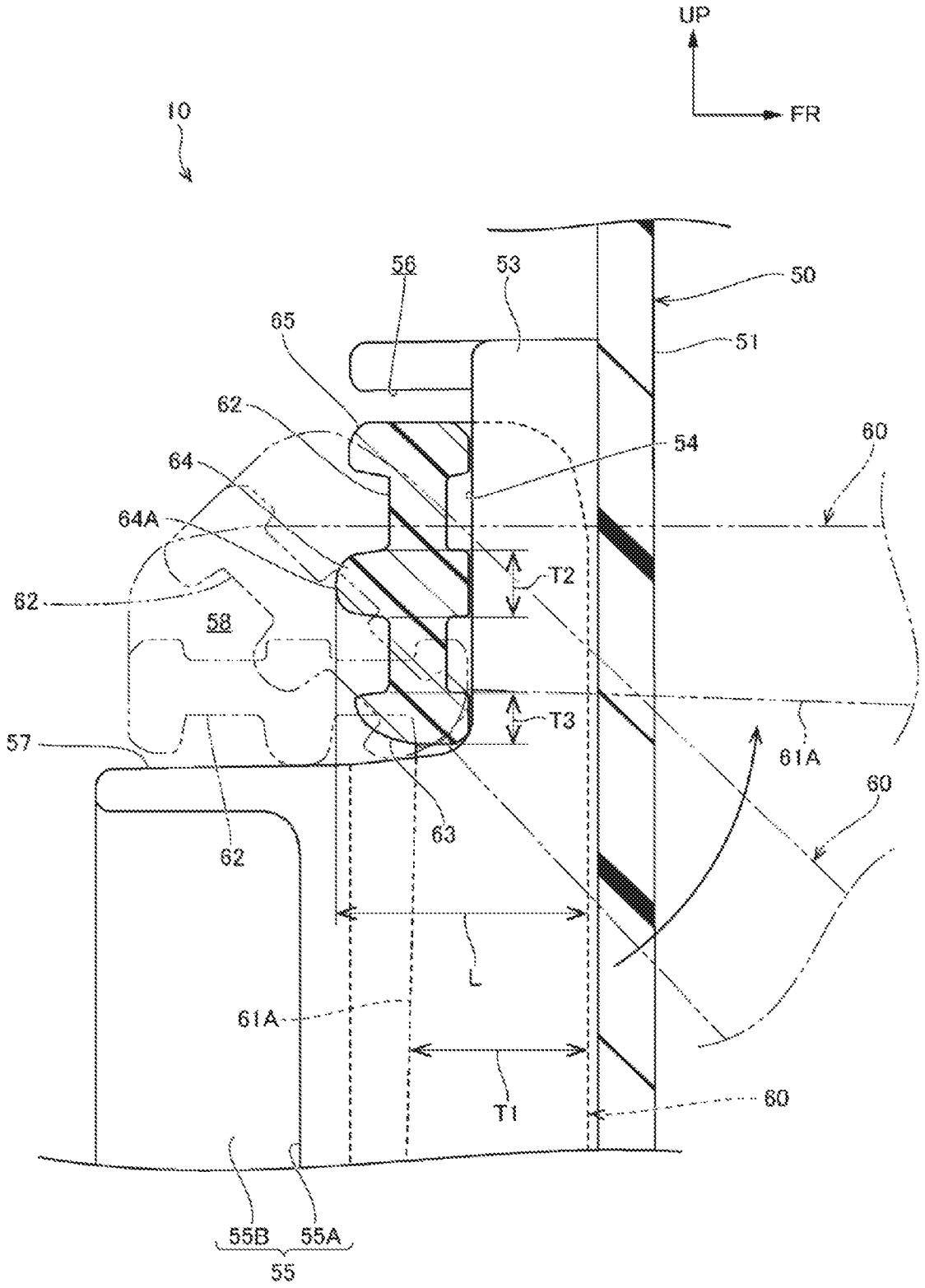
FIG. 13 is a sectional view seen from a left side illustrating a state in which the hinge piece of the opening-closing panel illustrated in FIG. 12A is housed in the hinge housing portion of the frame member (a sectional view taken along line XIII-XIII in FIG. 12A).

As illustrated in FIGS. 12A, 12B and FIG. 13, at the distal end part (rear end part) of the frame inner peripheral wall 53, a concave shaped hinge housing portion 54 that is open to the rear side is formed at both corner portions of the upper side. The hinge housing portion 54 is disposed on the front side of the rail portion 28 (specifically, the rail wall 27) of the case main body 20. In addition, a protrusion portion 55 protruding to the inside of the frame member 50 is formed on the frame inner peripheral wall 53 on a portion except the frame inner peripheral wall 53 at the upper side and the hinge housing portion 54. The protrusion portion 55 extends in the circumferential direction of the frame inner peripheral wall 53, and is formed in a substantially U-shape that is open to the upper side in a front view. As a result, an opening portion 56 that is configured with the upper end part and the protrusion portion 55 of the frame inner peripheral wall 53 is formed inside the frame member 50.

In addition, the protrusion portion 55 is formed in a substantially L-shape when viewed from the longitudinal direction. Specifically, the protrusion portion 55 includes a first protrusion wall 55A extending from the distal end part (rear end part) of the frame inner peripheral wall 53 to the inside of the frame member 50 and a second protrusion wall 55B extending from the distal end part of the first protrusion wall 55A to the rear side. Furthermore, a support wall 57 is formed at both end parts of the protrusion portion 55 in the longitudinal direction, and the support wall 57 is disposed with the vertical direction as the plate thickness direction and is connected to the protrusion portion 55 and the frame inner peripheral wall 53. In addition, the position of the upper surface of the support wall 57 in the vertical direction substantially coincides with the position of the upper surface of the rail wall 27 of the case main body 20. Furthermore, a space on the upper side of the support wall 57 is configured as a frame side insertion portion 58, and the frame side insertion portion 58 communicates with the hinge housing portion 54 and the opening portion 56. That is, the lower part of the frame side insertion portion 58 is formed by the support wall 57.

At the lower end part of the frame member 50, a concave shaped hand holding concave portion 50A opened to the upper side and the front side is formed on the left-right direction center part. Furthermore, an engaging hook 59 is formed on the left-right direction center part of the second protrusion wall 55B at the lower side, the engaging hook 59 protrudes from the second protrusion wall 55B to the upper side and extends in the left-right direction.

In the packaging state of the storage box 10, or the like, the frame member 50 is disposed at the lower side of the top plate 40 in the area surrounded by the top plate groove portion 41A, and is held by the holding portion 46. Specifically, the holding hook portion 46A of the holding portion 46 in the top plate 40 engages with the outer peripheral portion of the frame member 50, and the frame member 50 is held by the top plate 40. In the state in which the frame member 50 is held by the top plate 40, the thickness dimension of the frame member 50 is set to be equal to or less than the depth dimension of the top plate groove portion 41A such that the frame member 50 does not protrude more than the top plate groove portion 41A.

Regarding Opening-Closing Panel

Figure 14:
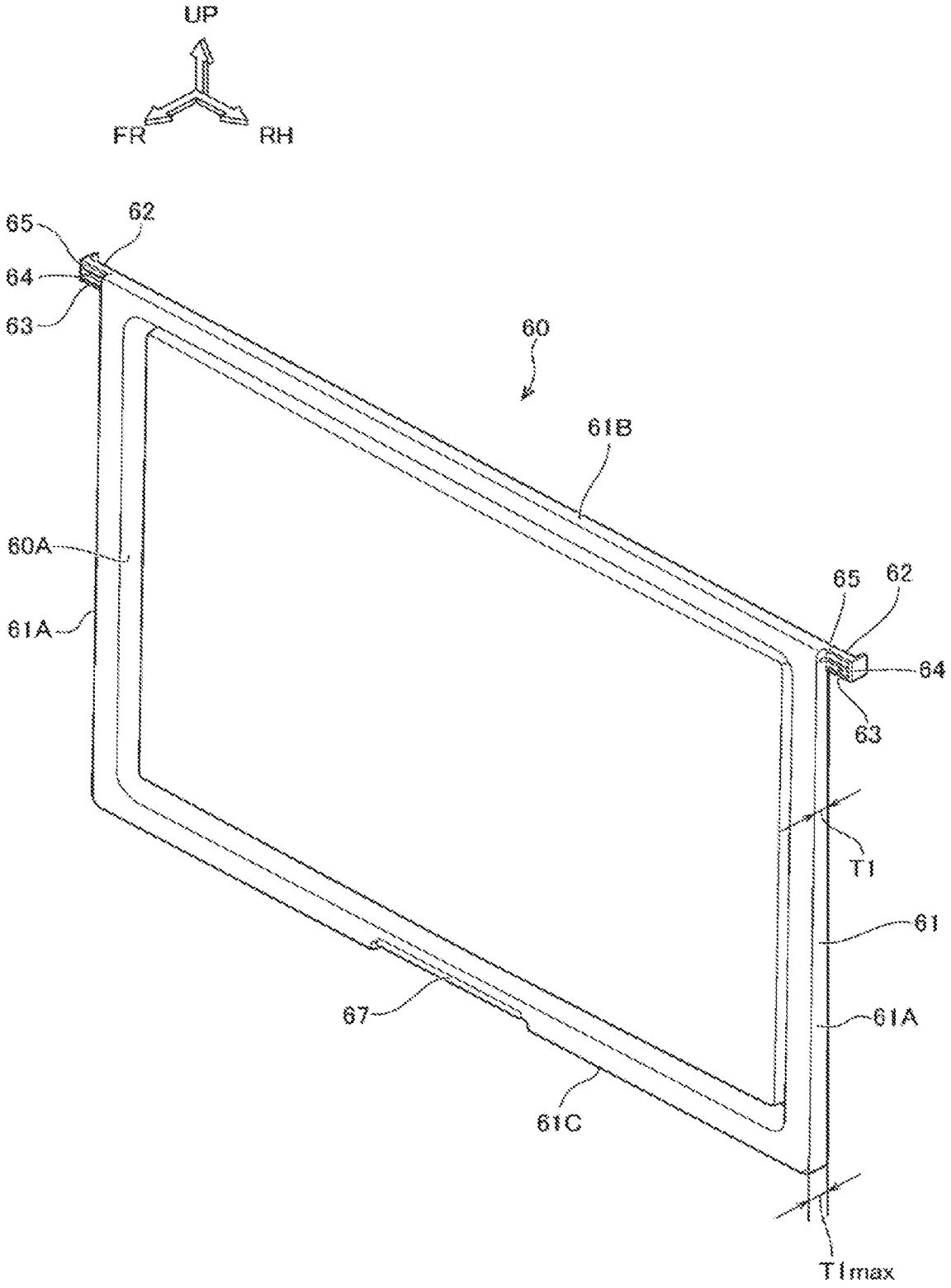
FIG. 14 is a perspective view of the opening-closing panel illustrated in FIG. 1.

As illustrated in FIG. 14, the opening-closing panel is made of a resin material and is formed with the front-rear direction as the plate thickness direction and the left-right direction as the longitudinal direction and having a substantially rectangular plate shape. The opening-closing panel 60 is disposed at the inside of the frame inner peripheral wall 53 of the frame member 50 and at the front side of the protrusion portion 55 of the frame member 50 (That is a position illustrated in FIG. 1 and hereinafter, this position of the opening-closing panel 60 is referred to as a "closed position"). As a result, the opening portion 56 of the frame member 50 is closed by the opening-closing panel 60 which is in the closed position. In addition, the dimension of the opening-closing panel 60 in the width direction is set to be slightly smaller than the distance between the left and right frame inner peripheral walls 53 of the frame member 50. As a result, at the closed position of the opening-closing panel 60, a back lash of the opening-closing panel 60 at the left and right with respect to the frame member 50 is suppressed.

Figure 15A:
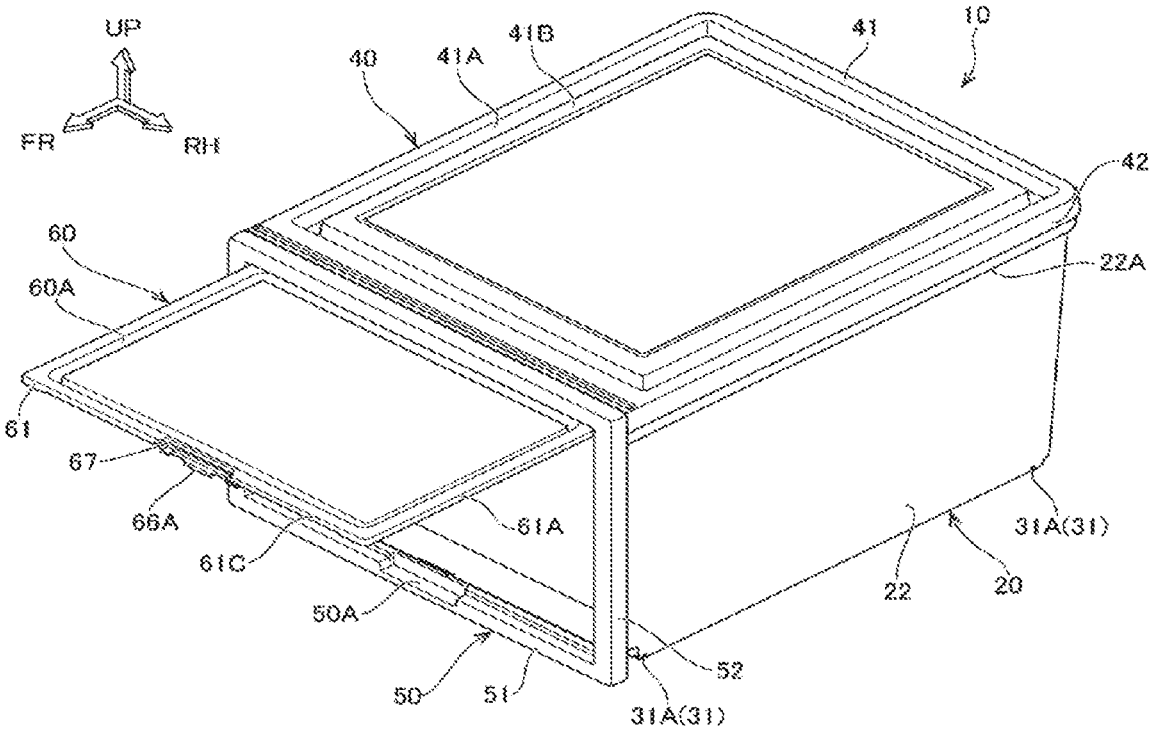
FIG. 15A is a perspective view illustrating a state in which the opening-closing panel illustrated in FIG. 1 is rotated to a rotation position.
Figure 15B:
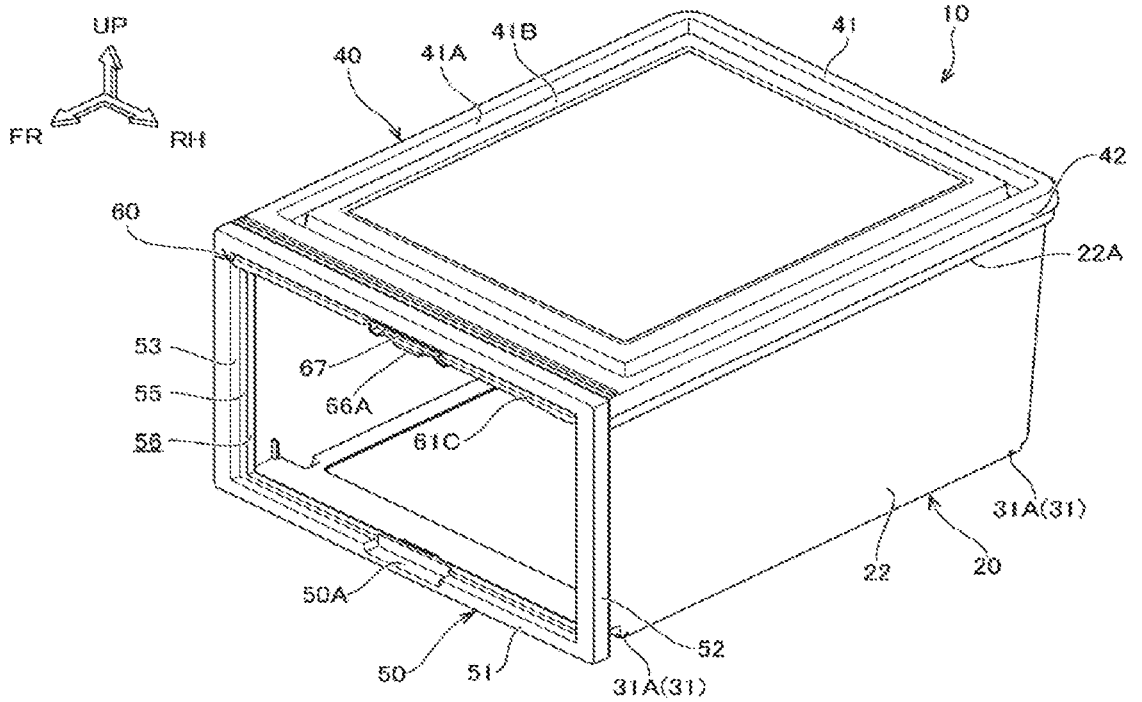
FIG. 15B is a perspective view illustrating a state in which the opening-closing panel is slid to a housing position.

In addition, although details will be described later, the opening-closing panel 60 is configured so as to be disposed at a housing position (position illustrated in FIG. 15B) in which the panel slides from the rotation position to the rear side, via a rotation position (the position illustrated in FIG. 15A) in which the panel is rotated from the closed position to the front side, by the opening-closing operation of the user. Specifically, at the rotation position of the opening-closing panel 60, the opening-closing panel 60 is disposed to be in a horizontal state. By sliding the opening-closing panel 60 in the horizontal state to the rear side, the opening-closing panel 60 is disposed to be at the housing position, and at the housing position, most of the opening-closing panel 60 is disposed inside the case main body 20.

On the outer peripheral edge of the opening-closing panel 60, a panel outer peripheral wall 61 extending to the rear side is integrally formed, and the panel outer peripheral wall 61 is formed over an entire circumference of the opening-closing panel 60. Specifically, the panel outer peripheral wall 61 is configured to include a panel side wall 61A extending to the rear side from the both end parts of the opening-closing panel 60 in the width direction, a panel upper wall 61B extending to the rear side from the upper end part of the opening-closing panel 60, and a panel lower wall 61C extending to the rear side from the lower end part of the opening-closing panel 60. As a result, both side parts of the opening-closing panel 60 in the width direction are configured as the panel side walls 61A. A thickness T1 of the panel side wall 61A in the front-rear direction becomes thicker and thicker as going from the upper side to the lower side. Specifically, in a side view, the distal end surface (rear end surface) of the panel side wall 61A is inclined toward the rear side as going toward the lower side. That is, in the horizontal state of the opening-closing panel 60 at the rotation position, the distal end surface of the panel side wall 61A is set to be inclined toward the lower side as going toward to the front side.

In addition, on the upper end part of the left and right panel side walls 61A, a pair of left and right hinge pieces 62 are formed on the rear end part of the panel side wall 61A, and the hinge piece 62 protrudes from the panel side wall 61A to the outside of the opening-closing panel 60 in the width direction with the front-rear direction as the plate thickness direction. In addition, the distal end part of the hinge piece 62 is bent to the rear side. A base end part of the hinge piece 62 is disposed inside the hinge housing portion 54 and the frame side insertion portion 58 of the frame member 50 (refer to FIGS. 12A to 12B). As a result, the lower end part of the hinge piece 62 is supported by the lower end part of the hinge housing portion 54 of the frame member 50, and the movement of the opening-closing panel 60 to the front side in the upper end part is restricted by the hinge housing portion 54.

As illustrated in FIGS. 12A, 12B, and FIG. 13, a rotation rib 63 is integrally formed with the lower end part of the hinge piece 62. The rotation rib 63 extends in the left-right direction and is formed from the base end part to the distal end part of the hinge piece 62. The rotation rib 63 is formed in a substantially rectangular shape with the front-rear direction as the longitudinal direction in a sectional view seen from the left-right direction, and protrudes to the front side and the rear side with respect to the hinge piece 62. Specifically, an amount of protrusion of the rotation rib 63 from the hinge piece 62 to the rear side is larger than an amount of protrusion of the rotation rib 63 from the hinge piece 62 to the front side, and the rear end part of the rotation rib 63 protrudes to the rear side from the distal end surface in the upper end part of the panel side wall 61A. Furthermore, the lower surface of the rotation rib 63 is curved in an arc shape that is convex downward and obliquely backward, and is disposed so as to be closed to the upper side of the lower side corner portion of the hinge housing portion 54 in the frame member 50.

Therefore, when the opening-closing panel 60 is rotated from the closed position to the rotation position, the lower surface of the rotation rib 63 is guided by the lower side corner portion of the hinge housing portion 54 so that the hinge piece 62 rotates inside the hinge housing portion 54 (refer to the opening-closing panel 60 indicated by the arrow and the chain double-dashed line in FIG. 13).

A slide rib 64 is integrally formed on the intermediate part of the hinge piece 62 in the vertical direction. Similarly to the rotation rib 63, the slide rib 64 extends in the left-right direction and is formed from the base end part to the distal end part of the hinge piece 62. The slide rib 64 is formed in a substantially rectangular shape with the front-rear direction as the longitudinal direction in a sectional view seen from the left-right direction, and protrudes to the front side and the rear side with respect to the hinge piece 62. Specifically, an amount of protrusion of the slide rib 64 from the hinge piece 62 to the front side is set to be the same as the amount of protrusion of the rotation rib 63 from the hinge piece 62 to the front side. On the other hand, an amount of protrusion of the slide rib 64 from the hinge piece 62 to the rear side is set to be larger than the amount of protrusion of the rotation rib 63 from the hinge piece 62 to the rear side, and the rear end part of the slide rib 64 protrudes to the rear side from the distal end surface of the upper end part in the panel side wall 61A. More specifically, a distance L from the front surface of the opening-closing panel 60 in the front-rear direction to the rear end surface of the slide rib 64 is set to be the same as a maximum value T1max of the thickness T1 of the panel side wall 61A. That is, the distance L is set to be the same as the thickness T1max of the lower end part of the panel side wall 61A.

The rear end surface of the slide rib 64 is configured as a sliding surface 64A, and the sliding surface 64A is curved in a substantially arc shape that is convex toward the rear side seen from the left-right direction. When the opening-closing panel 60 is rotated to the rotation position, the sliding surface 64A of the slide rib 64 is in contact with the upper surface of the support wall 57 of the frame member 50 (refer to the opening-closing panel 60 indicated by the chain double-dashed line in FIG. 13). When the opening-closing panel 60 slides toward the rear side from the rotation position to the housing position, the distal end part of the hinge piece 62 is inserted into the rail portion 28 of the case main body 20, and the sliding surface 64A of the slide rib 64 slides on the rail wall 27 of the case main body 20. In addition, when the opening-closing panel 60 slides, the panel side wall 61A slides back and forth inside the frame side insertion portion 58. Furthermore, a thickness T2 (dimension in the vertical direction, refer to FIG. 13) of the slide rib 64 is set to be thicker (larger) than a thickness T3 (dimension in the vertical direction, refer to FIG. 13) of the rotation rib 63.

A stiffening rib 65 is integrally formed on the upper end part of the hinge piece 62. Similarly to the rotation rib 63, the stiffening rib 65 extends in the left-right direction and is formed from the base end part to the distal end part of the hinge piece 62. The stiffening rib 65 is formed in a substantially rectangular shape with the front-rear direction as the longitudinal direction in a sectional view seen from the left-right direction, and protrudes to the front side and the rear side with respect to the hinge piece 62. Specifically, an amount of protrusion of the stiffening rib 65 from the hinge piece 62 to the front side is set to be the same as the amount of protrusion of the rotation rib 63 from the hinge piece 62 to the front side. In addition, an amount of protrusion of the stiffening rib 65 from the hinge piece 62 to the rear side is set to be the same as the amount of protrusion of the rotation rib 63 from the hinge piece 62 to the rear side. At the housing position of the opening-closing panel 60, the stiffening rib 65 of the hinge piece 62 is in contact with the stopper portion 26 of the case main body 20, and the movement of the opening-closing panel 60 to the rear side is restricted.

Furthermore, on the outer peripheral portion of the opening-closing panel 60, a panel groove portion 60A opened to the front side is formed. The panel groove portion 60A extends along the circumferential direction of the opening-closing panel 60 and is formed in a rectangular ring shape in a front view. On the panel groove portion 60A at the lower side, a lock portion 66 is formed which protrudes to the lower side in the center part of the opening-closing panel 60 in the width direction. At the lower end part of the lock portion 66, a panel hook portion 66A which protrudes toward the lower side is formed. At the closed position of the opening-closing panel 60, the panel hook portion 66A and the engaging hook 59 of the frame member 50 are engaged with each other, and the rotation of the opening-closing panel 60 to the front side is restricted.

Furthermore, at the lower end part of the opening-closing panel 60, a handle portion 67 is formed at the center part in the width direction, and the lower end part of the handle portion 67 is cut out in a concave shape opened to the lower side. At the closed position of the opening-closing panel 60, the handle portion 67 is disposed within the hand holding concave portion 50A of the frame member 50. In this way, the user can hold the handle portion 67 and operate the opening-closing panel 60.

When assembling the opening-closing panel 60 to the frame member 50, the opening-closing panel 60 in the horizontal state is disposed at the rear side of the frame member 50, and the panel side wall 61A of the opening-closing panel 60 is inserted into the frame side insertion portion 58 of the frame member 50 from the rear side. As a result, the hinge piece 62 of the opening-closing panel 60 is disposed within the frame side insertion portion 58 and the hinge housing portion 54, and the opening-closing panel 60 is in a state of being disposed in the rotation position. In this state, the opening-closing panel 60 assembled to the frame member 50 can be disposed at the closed position by relatively rotating the opening-closing panel 60 with respect to the frame member 50. Then, the assembly of the storage box 10 is completed by assembling the frame member 50 to the case main body 20 and the top plate 40 in the state in which the opening-closing panel 60 is assembled to the frame member 50. In addition, in the packaging state of the storage box 10, or the like, by holding the frame member 50 to which the opening-closing panel 60 is assembled to, by the top plate 40, the top plates 40 holding the frame member 50 and the opening-closing panel 60 can be stacked vertically.

Operational Effects

Next, operational effects of the present embodiment will be described.

In the storage box 10 configured as described above, as illustrated in FIG. 1, at the closed position of the opening-closing panel 60, the opening portion 56 of the frame member 50 is closed by the opening-closing panel 60. When storing a storage article in the storage portion 24 of the case main body 20, the user holds the handle portion 67 of the opening-closing panel 60 and rotates the opening-closing panel 60 toward the front side. In this way, the lower surface of the rotation rib 63 of the hinge piece 62 in the opening-closing panel 60 is guided by the corner portion of the lower side of the hinge housing portion 54 of the frame member 50, and the and the hinge piece 62 rotates inside the hinge housing portion 54. As a result, the opening-closing panel 60 is disposed at the rotation position (refer to FIG. 15A).

Next, the user presses the opening-closing panel 60 at the rotation position to the rear side to slide. As a result, the distal end part of the hinge piece 62 in the opening-closing panel 60 is inserted into the rail portion 28 of the case main body 20, and the sliding surface 64A of the slide rib 64 at the hinge piece 62 slides on the rail wall 27 of the case main body 20. At this time, the panel side wall 61A of the opening-closing panel 60 slides inside the frame side insertion portion 58 of the frame member 50. The upper end part of the hinge piece 62 comes into contact with the stopper portion 26 of the case main body 20, and thus, the sliding of the opening-closing panel 60 to the rear side is restricted, and the opening-closing panel 60 is disposed at the housing position. As a result, the opening portion 56 of the frame member 50 is opened in a state in which the opening-closing panel 60 is housed inside the storage box 10. Therefore, the user can store the storage article into the storage portion 24 of the case main body 20 from the opening portion 56.

After storing the storage article in the storage portion 24 of the case main body 20, the user pulls the opening-closing panel 60 from the housing position to the rotation position, and by rotating the opening-closing panel 60 at the rotation position to the rear side, the opening-closing panel 60 is disposed at the closed position. As a result, the opening portion 56 is closed by the opening-closing panel 60.

Here, the storage box 10 is configured to include a rectangular parallelepiped box-shaped case main body 20 opened to the front side and the upper side, and a top plate 40 assembled to the upper end part of the case main body 20, and a rectangular frame-shaped frame member 50 is assembled to the front end part (case side mounting portion 25) of the case main body 20 and the front end part (top plate side mounting portion 47) of the top plate 40. Therefore, the front end part of the case main body and the front end part of the top plate 40 are reinforced by the frame member 50.

As a result, the rigidity of the front end part of the storage box 10 can be increased by the frame member 50. In addition, the opening-closing panel 60 is rotatably assembled to the frame member 50. The opening-closing panel 60 is disposed at the rotation position by being rotated from the closed position to the front side, and by sliding from the rotation position to the rear side the rail portion 28 of the case main body 20 is slid, and then, is disposed at the housing position. As a result, at the housing position, since most of the opening-closing panel 60 is housed in the case main body 20, it is possible to improve the convenience for users when taking the storage article in and out of the storage box 10.

In addition, the frame member 50 is formed in a rectangular frame shape. As a result, when vertically stacking the storage box 10, since the rectangular shaped frame members 50 are vertically disposed side by side, the front appearance of the storage box 10 in the stacking state can be made rectangular. In addition, when horizontally disposing the storage box 10 side by side, the storage box 10 can be disposed while the side surfaces of the frame members 50 disposed side by side can be brought into close contact with each other. Therefore, it is possible to improve the design when disposing a plurality of storage boxes 10 side by side. In addition, the opening portion 56 of the storage box 10 is configured with the frame member 50 which is a single member. Therefore, it is possible to improve a design of the storage box 10 when the opening portion 56 is opened.

In addition, a pair of left and right hinge pieces 62 protruding to the outside in the width direction are formed in the upper end part of the opening-closing panel 60. In the hinge piece 62, the rotation rib 63 that is guided by the hinge housing portion 54 of the frame member when the opening-closing panel 60 rotates, and the slide rib 64 that slides on the rail portion 28 (rail wall 27) of the case main body 20 when the opening-closing panel 60 slides, and the thickness T2 of the slide rib 64 is set to be thicker than the thickness T3 of the rotation rib 63. Therefore, the opening-closing panel 60 can be slid satisfactorily and a wear of the slide rib 64 can be reduced. In addition, by providing the rotation rib 63 and the slide rib 64 separately, it is possible to reduce the wear of the rotation rib 63 and the slide rib 64 when the opening-closing panel 60 rotates and slides.

In addition, at the housing position of the opening-closing panel 60, the support wall 57 that supports the lower end part of the panel side wall 61A of the opening-closing panel 60 is provided on the frame member 50. Furthermore, the distal end surface (rear end surface) of the panel side wall 61A of the opening-closing panel 60 is inclined to the rear side as going toward the lower side, and the rear end part of the slide rib 64 of the opening-closing panel 60 protrudes to the rear side from the upper end part of the panel side wall 61A. As a result, it is possible to improve the design of the storage box 10 when the opening-closing panel 60 is disposed in the housing position, while improving the sliding performance of the opening-closing panel 60. Hereinafter, this point will be described in comparison with the opening-closing panel 60 in a comparison example.

In an opening-closing panel 60 of the comparison example, a distal end surface (rear end surface) of the panel side wall 61A of the opening-closing panel 60 is formed along the vertical direction. That is, a thickness T1 of the panel side wall 61A in the opening-closing panel 60 is set to be constant in the vertical direction. In addition, in the opening-closing panel 60 of the comparison example, a position of the rear end surface of the slide rib 64 of the opening-closing panel 60 In the front-rear direction and a position of the distal end surface of the panel side wall 61A are coincident with each other. That is, the rear end part of the slide rib 64 does not protrude toward the rear side from the distal end surface of the panel side wall 61A.

Here, at the time when the opening-closing panel 60 slides from the rotation position to the rear side, the slide rib 64 of the opening-closing panel 60 slides on the upper surface of the rail wall 27 of the case main body 20, and the panel side wall 61A of the opening-closing panel 60 slides inside the frame side insertion portion 58 of the frame member 50. That is, the panel side wall 61A slides on the upper side of the support wall 57 of the frame member 50.

Figure 16B:
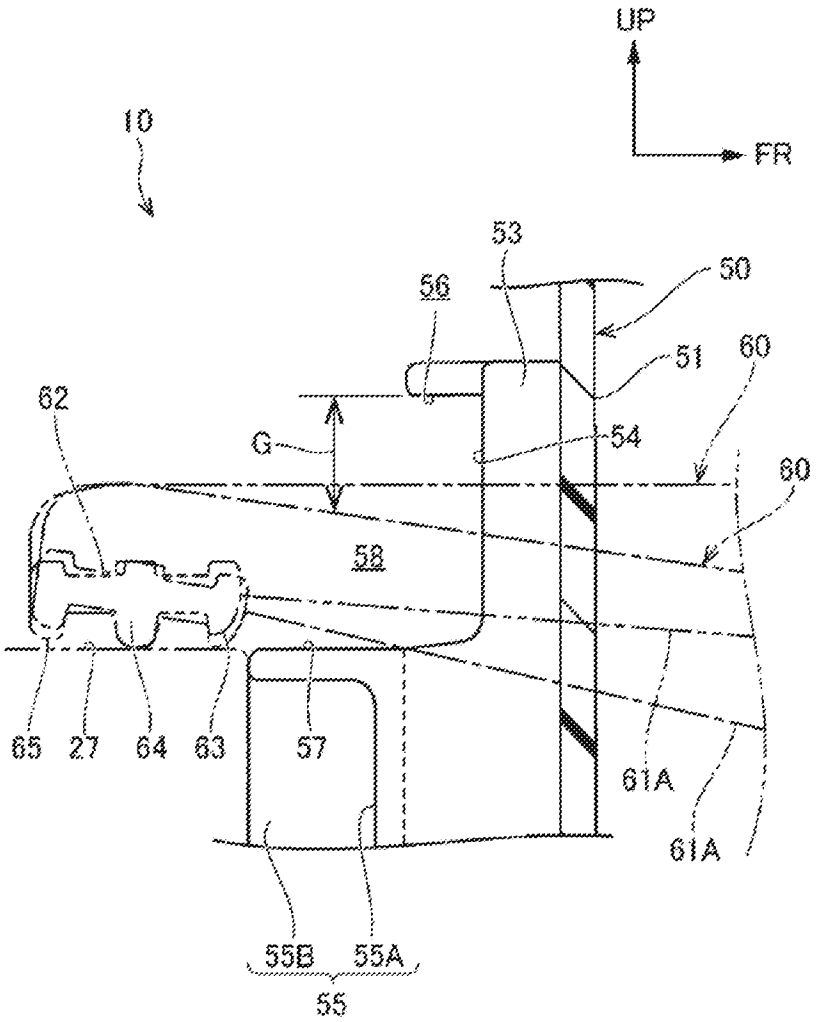
FIG. 16B is an explanatory diagram for explaining a sliding operation from the rotation position to the rear side in the opening-closing panel of the present embodiment.
Figure 16A:
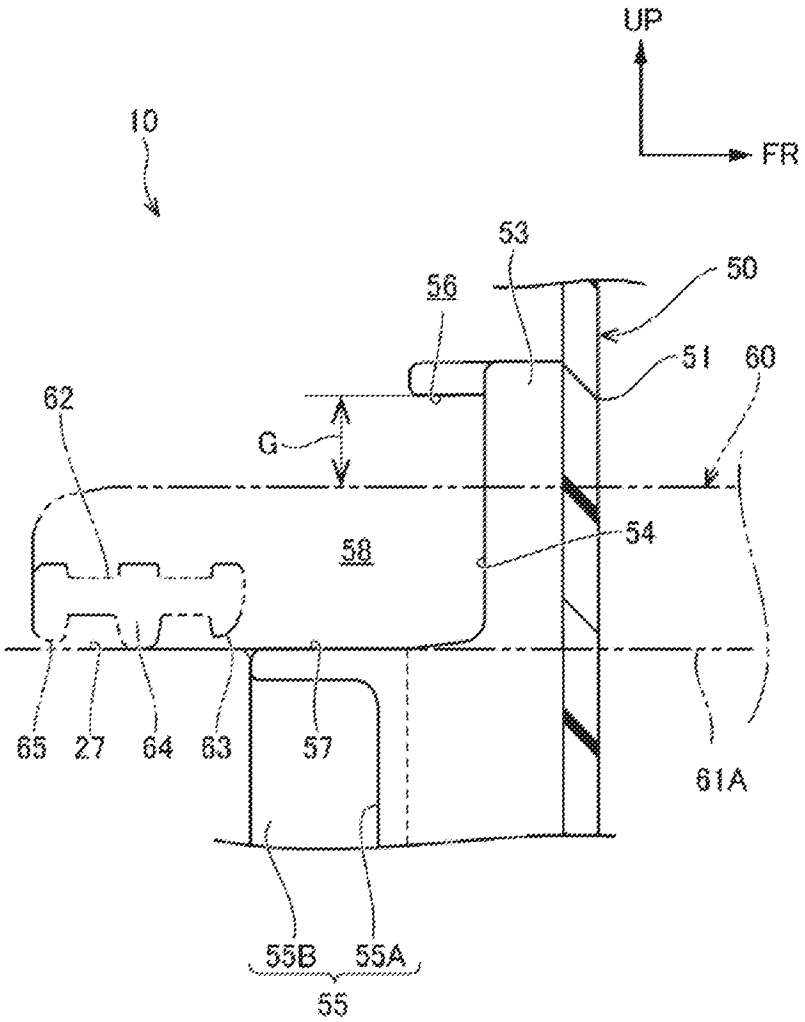
FIG. 16A is an explanatory diagram for explaining a sliding operation from the rotation position to the rear side in the opening-closing panel in a comparison example.

As illustrated in FIG. 16A, when the opening-closing panel 60 in the comparison example in the horizontal state slides from the rotation position to the rear side, since the rear end surface of the slide rib 64 does not protrude toward the rear side from the distal end surface of the panel side wall 61A, the distal end surface of the panel side wall 61A slides while being into contact with the support wall 57. Therefore, in the opening-closing panel 60 in the comparison example, the sliding resistance when the opening-closing panel 60 slides tends to increase.

In addition, for example, if the center part of the opening-closing panel 60 in the width direction is warped to the front side after the opening-closing panel 60 is molded, a gap G between the front surface of the opening-closing panel 60 and the upper end of the opening portion of the frame member 50 in the vertical direction becomes small. As a result, in the opening-closing panel 60 in the comparison example, due to the warping of the opening-closing panel 60 after molding, the opening-closing panel 60 interferes with the opening portion 56 (of the upper end part), and thus, there is a possibility that the opening-closing panel 60 cannot be slid satisfactorily.

On the other hand, in the present embodiment, as described above, the distal end surface (rear end surface) of the panel side wall 61A of the opening-closing panel 60 is inclined to the rear side as going to the lower side, and the rear end part of the slide rib 64 of the opening-closing panel 60 protrudes toward the rear side from the upper end part of the panel side wall 61A. Therefore, as illustrated in FIG. 16B, in the opening-closing panel 60 in the present embodiment, when sliding the opening-closing panel 60 in the horizontal state from the rotation position to the rear side, it is possible to prevent the distal end surface of the panel side wall 61A from coming into contact with the support wall 57 (refer to the opening-closing panel 60 indicated by a chain double-dashed line in FIG. 16B). Therefore, compared to the comparison example described above, the sliding resistance of the opening-closing panel 60 during sliding can be reduced.

In addition, If the center part of the opening-closing panel 60 in the width direction is warped to the front side after the opening-closing panel 60 is molded, it is possible to slide the opening-closing panel 60 to the rear side by making the opening-closing panel 60 to be slightly inclined to the lower side as going to the front side (refer to the opening-closing panel 60 indicated by the chain dashed line in FIG. 16B). In this way, the gap G in the vertical direction between the front surface of the opening-closing panel 60 and the upper end of the opening portion 56 of the frame member 50 when sliding the opening-closing panel 60 can be made larger than that in the comparison example described above. Therefore, for example, even if the center part of the opening-closing panel 60 in the width direction after molding is warped to the front side, the interference between the opening-closing panel 60 and the opening portion 56 (of the upper end part) is suppressed, and thus, it is possible to satisfactorily slide the opening-closing panel 60.

Moreover, the distance L from the front surface of the opening-closing panel 60 to the rear end surface of the slide rib 64 in the front-rear direction is set to be the same as the thickness T1max in the lower end part of the panel side wall 61A. At the housing position of the opening-closing panel 60, the distal end surface of the lower end part in the panel side wall 61A is supported from the lower side by the support wall 57 of the frame member 50. That is, the thick lower end part of the panel side wall 61A is supported by the support wall 57. Therefore, the opening-closing panel 60 can be disposed at the housing position while being in the horizontal state. As a result, it is possible to prevent the gap G in the vertical direction between the upper end of the opening portion 56 of the frame member 50 and the front surface of the opening-closing panel 60 at the housing position of the opening-closing panel 60 from increasing. As described above, while improving the sliding performance of the opening-closing panel 60, it is possible to improve the design of the storage box 10 when the opening-closing panel 60 is disposed at the housing position.

In addition, in the present embodiment, in the disassembled state of the storage box 10, by engaging the upper end part of the engaging rib 30 of the case main body 20 at the lower side into the engagement groove portion 31A of the case main body 20 at the upper side, it is possible to nest the case main bodies 20. That is, it is possible to nest a plurality of case main bodies 20 by the groove engagement. Therefore, it is possible to nest a plurality of case main bodies 20 with a simple configuration.

In addition, the upper end surface of the engaging rib 30 and the upper end surface of the engagement groove portion 31A in the engaged portion 31 are inclined toward upper the side in a front view as going toward the inside of the case main body 20 in the width direction. Therefore, when the engaging rib 30 is engaged in the engagement groove portion 31A, the upper end surface of the engaging rib 30 and the upper end surface of the engagement groove portion 31A come in contact with each other. As a result, when nesting the plurality of case main bodies 20, the engaging rib 30 and the engagement groove portion 31A are engaged in the left-right direction. Accordingly, when the engaging rib 30 comes in contact with the with the engagement groove portion 31A to engaged, even if a load is applied from above (vertical direction), the state of nesting can be maintained, and thus, it is possible to prevent the side wall 22 of the case main body 20 from being deformed to the outside in the width direction. Therefore, it is possible to secure the stability of the state in which the case main body 20 is nested.

In addition, the top plate 40 includes a holding portion 46 that holds the frame member 50. Therefore, in the disassembled state of the storage box 10, the frame member 50 to which the opening-closing panel 60 assembled can be held by the top plate 40. As a result, for example, the packaging performance can be improved such as when the storage box 10 is transported in the disassembled state.

What is claimed is:

1. A storage box comprising:

a rectangular parallelepiped box-shaped case main body that is opened to a front side and an upper side, the case main body including a side wall and a pair of left and right rail portions on an upper end side part of the side wall;

a top plate that is removably coupled to an upper end part of the case main body;

a frame member having a rectangular frame shape and an opening portion inside, and being removably coupled to a front end part of the case main body and a front end part of the top plate; and an opening-closing panel that is rotatably coupled to the frame member to rotate between a closed position that closes the opening portion and a rotation position that is rotated from the closed position, and is configured to slide on the rail portion to a housing position by sliding from the rotation position toward a rear side of the case main body, and the opening-closing panel comprising:

a hinge piece at an upper end part of the opening-closing panel, the hinge piece protruding toward an outside in a width direction of the opening-closing panel, and the hinge piece comprising:

a rotation rib that extends in a protrusion direction of the hinge piece and is guided by the frame member when the opening-closing panel is rotated, and a slide rib that extends in the protrusion direction of the hinge piece and slides on the rail portion when the opening-closing panel slides, and a thickness of the slide rib is thicker than a thickness of the rotation rib.

2. The storage box according to claim 1, wherein the frame member includes a support wall that supports both side parts of the opening-closing panel in the width direction at the housing position, a rear end surface of both side parts of the opening-closing panel in the width direction is inclined to the rear side as going toward a lower side, and the slide rib protrudes toward the rear side from the upper end part of both side parts of the opening-closing panel in the width direction.

3. The storage box according to claim 2, wherein a distance in a front-rear direction from a front surface of the opening-closing panel to a rear end surface of the slide rib is the same as a thickness of a lower end part of both side parts of the opening-closing panel in the width direction.

4. A storage box comprising:

a rectangular parallelepiped box-shaped case main body that is opened to a front side and an upper side, the case main body including a side wall and a pair of left and right rail portions on an upper end side part of the side wall;

a top plate that is removably coupled to an upper end part of the case main body;

a frame member having a rectangular frame shape and an opening portion inside, and being removably coupled to a front end part of the case main body and a front end part of the top plate; and an opening-closing panel that is rotatably coupled to the frame member to rotate between a closed position that closes the opening portion and a rotation position that is rotated from the closed position, and is configured to slide on the rail portion to a housing position by sliding from the rotation position toward a rear side of the case main body, and the opening-closing panel comprising:

a hinge piece at an upper end part of the opening-closing panel, the hinge piece protruding toward an outside in a width direction of the opening-closing panel, and the hinge piece comprising:

a rotation rib that extends in a protrusion direction of the hinge piece and is guided by the frame member when the opening-closing panel is rotated, and a slide rib that extends in the protrusion direction of the hinge piece and slides on the rail portion when the opening-closing panel slides, and an amount of protrusion of the slide rib from the hinge piece toward the rear side of the case main body is larger than an amount of protrusion of the rotation rib when the opening-closing panel is in the closed position.

5. The storage box according to claim 4, wherein the frame member includes a support wall that supports both side parts of the opening-closing panel in the width direction at the housing position, a rear end surface of both side parts of the opening-closing panel in the width direction is inclined to the rear side as going toward a lower side, and the slide rib protrudes toward the rear side from the upper end part of both side parts of the opening-closing panel in the width direction.

6. The storage box according to claim 5, wherein a distance in a front-rear direction from a front surface of the opening-closing panel to a rear end surface of the slide rib is the same as a thickness of a lower end part of both side parts of the opening-closing panel in the width direction.

* * * * *